US010166425B2

(12) United States Patent
Habing

(10) Patent No.: US 10,166,425 B2
(45) **Date of Patent: *Jan. 1, 2019**

(54) HYBRID RESISTANCE SYSTEM

(71) Applicant: Douglas John Habing, Rancho Santa Fe, CA (US)

(72) Inventor: Douglas John Habing, Rancho Santa Fe, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/235,489

(22) Filed: Aug. 12, 2016

(65) Prior Publication Data

US 2016/0346585 A1 Dec. 1, 2016

Related U.S. Application Data

(63) Continuation of application No. 13/801,941, filed on Mar. 13, 2013, now Pat. No. 9,415,257.
(Continued)

(51) Int. Cl.
*A63B 21/00* (2006.01)
*A63B 21/005* (2006.01)
(Continued)

(52) U.S. Cl.
CPC ..... *A63B 21/00072* (2013.01); *A63B 21/005* (2013.01); *A63B 21/008* (2013.01);
(Continued)

(58) Field of Classification Search
CPC ... A63B 21/0072; A63B 21/023; A63B 21/04; A63B 21/0407; A63B 21/0435;
(Continued)

(56) References Cited

U.S. PATENT DOCUMENTS 3,885,789 A * 5/1975 Deluty ..... A63B 21/018 242/147 R
4,470,597 A 9/1984 McFee
(Continued)

FOREIGN PATENT DOCUMENTS

EP 248249 11/1990
EP 2666524 11/2013
(Continued)

OTHER PUBLICATIONS

International Search Report; Application No. PCT/US2013/045998; Filed Jun. 14, 2013.
(Continued)

*Primary Examiner* — Jennifer M Deichl
(74) *Attorney, Agent, or Firm* — Knobbe, Martens, Olson & Bear, LLP

(57) ABSTRACT

A resistance system, which can be suitable for incorporation in exercise equipment, is a "hybrid" resistance assembly having at least a first and a second resistance unit. The first resistance unit can be of a first type and the second resistance unit can be of a second type. The first resistance unit can be an inertial resistance unit, which incorporates an inertial load that creates resistance influenced by the inertia of a movable mass, such as a rotatable flywheel. The second resistance unit can be a static or non-inertial resistance unit, such as a displacement resistance unit, which incorporates a load that creates resistance influenced by displacement (e.g., linear or rotational displacement) of an input to the displacement resistance unit.

33 Claims, 19 Drawing Sheets

Related U.S. Application Data

(60) Provisional application No. 61/661,294, filed on Jun. 18, 2012.

(51) Int. Cl.

| | |
|---|---|
| ***A63B 21/008*** | (2006.01) |
| ***A63B 21/02*** | (2006.01) |
| ***A63B 21/04*** | (2006.01) |
| ***A63B 21/06*** | (2006.01) |
| ***A63B 21/062*** | (2006.01) |
| ***A63B 21/22*** | (2006.01) |
| ***A63B 22/00*** | (2006.01) |
| ***A63B 22/02*** | (2006.01) |
| ***A63B 22/06*** | (2006.01) |
| ***A63B 22/20*** | (2006.01) |
| ***A63B 23/04*** | (2006.01) |
| ***A63B 23/08*** | (2006.01) |
| ***A63B 24/00*** | (2006.01) |
| ***A63B 71/00*** | (2006.01) |

(52) U.S. Cl.

CPC .... *A63B 21/0055* (2015.10); *A63B 21/00192* (2013.01); *A63B 21/023* (2013.01); *A63B 21/0428* (2013.01); *A63B 21/0618* (2013.01); *A63B 21/15* (2013.01); *A63B 21/153* (2013.01); *A63B 21/154* (2013.01); *A63B 21/155* (2013.01); *A63B 21/157* (2013.01); *A63B 21/159* (2013.01); *A63B 21/22* (2013.01); *A63B 21/225* (2013.01); *A63B 21/227* (2013.01); *A63B 21/4023* (2015.10); *A63B 21/4043* (2015.10); *A63B 22/0056* (2013.01); *A63B 22/0076* (2013.01); *A63B 22/02* (2013.01); *A63B 22/0605* (2013.01); *A63B 22/0664* (2013.01); *A63B 22/205* (2013.01); *A63B 23/0405* (2013.01); *A63B 21/0051* (2013.01); *A63B 21/0085* (2013.01); *A63B 21/0628* (2015.10); *A63B 22/00* (2013.01); *A63B 23/0494* (2013.01); *A63B 23/085* (2013.01); *A63B 24/0062* (2013.01); *A63B 24/0087* (2013.01); *A63B 2022/0079* (2013.01); *A63B 2023/0411* (2013.01); *A63B 2071/009* (2013.01); *A63B 2207/02* (2013.01); *A63B 2230/06* (2013.01); *A63B 2230/75* (2013.01)

(58) Field of Classification Search

CPC ... A63B 21/151; A63B 21/153; A63B 21/154; A63B 21/155; A63B 21/157; A63B 21/159; A63B 22/0076–2022/0084; A63B 69/06–2069/062; A63B 21/00192–21/0557; A63B 21/22–21/225

See application file for complete search history.

(56) References Cited

U.S. PATENT DOCUMENTS

| | | | | |
|---|---|---|---|---|
| 4,822,036 | A | 4/1989 | Dang | |
| 4,884,800 | A | 12/1989 | Duke | |
| 5,072,929 | A | 12/1991 | Peterson et al. | |
| 5,328,429 | A * | 7/1994 | Potash ..... | A63B 21/0058 482/4 |
| 5,344,374 | A | 9/1994 | Telle | |
| 5,643,153 | A | 7/1997 | Nylen et al. | |
| 5,820,519 | A | 10/1998 | Slenker | |
| 6,302,829 | B1 | 10/2001 | Schmidt | |
| 6,561,956 | B1 | 5/2003 | Allison | |
| 6,599,223 | B2 | 7/2003 | Wang et al. | |
| 7,462,141 | B1 | 12/2008 | Raboin et al. | |
| 7,507,190 | B2 | 3/2009 | Piane, Jr. | |
| 7,553,262 | B2 | 6/2009 | Paine, Jr. | |
| 7,998,038 | B2 | 8/2011 | Keiser | |
| 8,016,730 | B2 | 9/2011 | Allesandri et al. | |
| 2004/0224827 | A1 | 11/2004 | Ashley | |
| 2005/0239612 | A1 | 10/2005 | Keiser | |
| 2006/0040800 | A1 | 2/2006 | Slyter | |

FOREIGN PATENT DOCUMENTS

| | | |
|---|---|---|
| GB | 2227676 | 8/1990 |
| JP | S57-38262 | 8/1982 |
| JP | H02-265577 | 10/1990 |
| JP | H2-265577 | 10/1990 |
| JP | 2009-528109 | 8/2009 |
| JP | 59-96053 | 9/2016 |
| WO | WO 99/04864 | 2/1999 |
| WO | WO 2005/044391 | 5/2005 |
| WO | WO 2011-017250 | 2/2011 |
| WO | WO 2012/053259 | 4/2012 |

OTHER PUBLICATIONS

Notification of Reasons for Refusal, Application No. JP 2015-518470, dated Oct. 6, 2017, in 9 pages.

* cited by examiner

HYBRID RESISTANCE SYSTEM

INCORPORATION BY REFERENCE TO RELATED APPLICATIONS

Any and all priority claims identified in the Application Data Sheet, or any correction thereto, are hereby incorporated by reference herein and made a part of the present disclosure.

BACKGROUND OF THE INVENTION

Field of the Invention

The present invention relates generally to resistance systems well-suited for use in connection with equipment for exercising. In particular, the present invention relates to resistance systems having multiple types of resistance loads and/or multiple modes of employing the resistance loads.

Description of the Related Art

Exercise equipment or machines generally incorporate a source of resistance to the motion being performed. The source of resistance can be mechanical, electro-mechanical, electronic, magnetic, pneumatic or hydraulic, among others. The various types of resistance sources have various properties, which can be advantageous or disadvantageous in a given application. A single type of resistance source can work well in some applications, but usually does not work well in all exercise equipment applications.

SUMMARY OF THE INVENTION

Accordingly, a need exists for improved resistance systems that provide a flexible and adjustable resistance load output, and which can be used in connection with or incorporated into exercise equipment, or can be used for other applications. Preferably, such systems include at least two sources of resistance. In some configurations, the sources of resistance are different from one another. In addition, in some arrangements, the resistance unit has multiple modes of operation for actuating the available resistance sources. The systems, methods and devices described herein have innovative aspects, no single one of which is indispensable or solely responsible for their desirable attributes. Without limiting the scope of the claims, some of the advantageous features will now be summarized.

A preferred embodiment involves a resistance system for incorporation in exercise equipment, including a first resistance unit comprising an inertial resistance load and a second resistance unit comprising a non-inertial resistance load. A user interface is movable by a user in a first direction and a second direction, wherein the user interface is capable of utilizing one or both of the first resistance unit and the second resistance unit. A mode selector permits selection between at least a first mode, a second mode and a third mode. In the first mode, the user interface utilizes the inertial resistance load of the first resistance unit in both of the first and second directions and utilizes the non-inertial resistance load of the second resistance in at least one of the first and second directions. In the second mode, the user interface utilizes the inertial resistance load of the first resistance unit in only one of the first and second directions and utilizes the non-inertial resistance load of the second resistance in at least one of the first and second directions. In the third mode, the user interface does not utilize the inertial resistance load of the first resistance unit in either of the first and second directions and utilizes the non-inertial resistance load of the second resistance in at least one of the first and second directions.

In some configurations, the inertial resistance load comprises a flywheel. The non-inertial resistance load can comprise a displacement load in which a resistance supplied is related to a displacement of a portion of the displacement load. The displacement load can be a spring.

In some configurations, the mode selector comprises a sliding collar. In some configurations, the mode selector comprises a first pin and a second pin that selectively engage a first drive plate and a second drive plate, respectively. An actuator can drive the first and second pins between an engaged position and a disengaged position.

In some configurations, in the third mode, the inertial resistance load is connected to an exercise device other than the user interface.

A preferred embodiment involves a resistance system for incorporation in exercise equipment, including a first resistance unit comprising an inertial resistance load and a second resistance unit comprising a non-inertial resistance load. At least one lever arm is movable about a lever arm axis in at least a first direction and a second direction, wherein the at least one lever arm is capable of connection to the first resistance unit and the second resistance unit. A mode selector permits selection between at least a first mode, a second mode and a third mode. In the first mode, movement of the at least one lever arm utilizes the inertial resistance load of the first resistance unit in both of the first and second directions and utilizes the non-inertial resistance load of the second resistance in at least one of the first and second directions. In the second mode, movement of the at least one lever arm utilizes the inertial resistance load of the first resistance unit in only one of the first and second directions and utilizes the non-inertial resistance load of the second resistance in at least one of the first and second directions. In the third mode, movement of the at least one lever arm does not utilize the inertial resistance load of the first resistance unit in either of the first and second directions and utilizes the non-inertial resistance load of the second resistance in at least one of the first and second directions.

In some configurations, the at least one lever arm comprises a first lever arm and a second lever arm, wherein the first lever arm drives the inertial resistance load in the first mode and the second lever arm drives the inertial resistance load in the second mode. The at least one lever arm can comprise a first lever arm, a second lever arm and a third lever arm, wherein the first lever arm and the second lever arm drive the inertial resistance load in the second mode, and wherein the third lever arm drives the inertial resistance load in the first mode. In some configurations, the third lever arm is linked to the first and second lever arms, such that movement of either the first lever arm or the second lever arm results in movement of the third lever arm.

In some configurations, the inertial resistance load comprises a flywheel. The non-inertial resistance load can comprise a displacement load in which a resistance supplied is related to a displacement of a portion of the displacement load. In some configurations, the displacement load is a spring.

In some configurations, the mode selector comprises a sliding collar. In some configurations, the mode selector comprises a first pin and a second pin that selectively engage a first drive plate and a second drive plate, respectively. An actuator can drive the first and second pins between an engaged position and a disengaged position.

A preferred embodiment involves a method of using an exercise resistance system, including selecting one of at least a first mode, a second mode and a third mode of resistance. The method also includes moving or controlling movement of a user interface in a first direction in response to a force applied by the resistance system comprising a combination of an inertial load and a non-inertial load in the first mode and the second mode and only a non-inertial load in the third mode. The method includes moving or controlling movement of the user interface in a second direction in response to a force applied by the resistance system comprising a combination of an inertial load and a non-inertial load in the first mode and only a non-inertial load in the second mode and the third mode.

In some configurations, the method includes adjusting at least one of the inertial load and the non-inertial load. In some configurations, the method includes adjusting the inertial load separately from the non-inertial load. In some configurations, the moving or controlling movement of the user interface comprises moving or controlling movement of a lever arm about a pivot axis.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Figure 1:
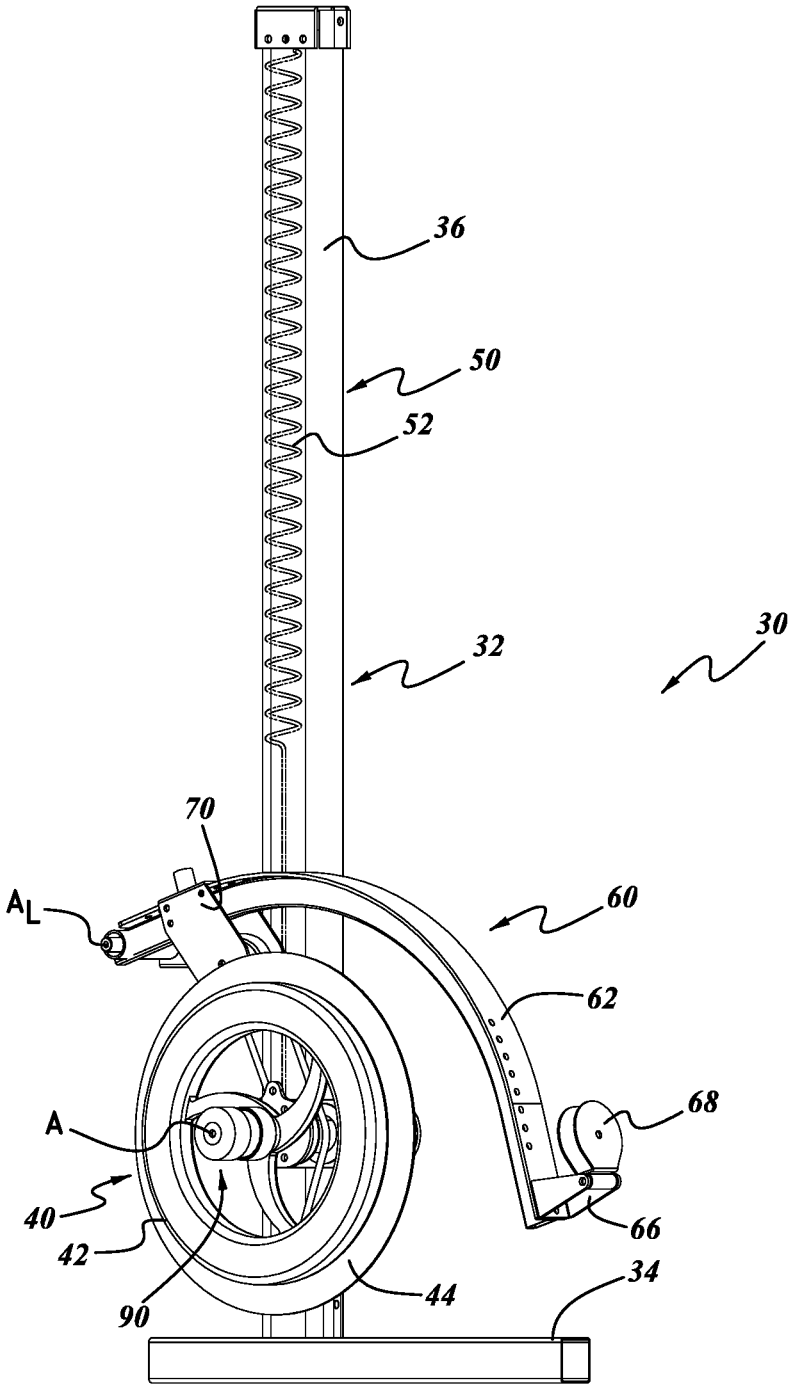
FIG. 1 is a perspective view of a side and front of a resistance system having certain features, aspects and advantages of one or more preferred embodiments.

One or more embodiments of the present disclosure involve a resistance system, which can be suitable for incorporation in exercise equipment, or exercise equipment incorporating such a resistance system. Although the resistance system is well-suited for use in various forms of exercise equipment, including cardiovascular training equipment, strength training equipment, and combinations thereof, the resistance system can find utility in other applications as well. Therefore, although described in the context of exercise equipment herein, it is not intended to limit the resistance system to such applications, unless specifically indicated or otherwise made clear from the context of the disclosure.

Preferably, the resistance system has at least a first resistance unit and a second resistance unit. The resistance units can be of the same type; however, in at least some configurations, the first resistance unit is of a first type and the second resistance unit is of a second type, which is different from the first type. Such a resistance assembly can be referred to as a "hybrid" resistance assembly herein. The resistance system is not limited to two resistance units or even two types of resistance units, however. Additional resistance units or additional types of resistance units can also be employed.

In some configurations, the first resistance unit is an inertial resistance unit, which incorporates an inertial load that creates resistance proportional to the inertia of a movable mass. The inertial resistance unit can comprise any suitable type of inertial load, such as a rotatable flywheel, for example and without limitation. As described above, preferably, the second resistance unit is a non-inertial resistance unit. In some configurations, the second resistance unit is a displacement resistance unit, which incorporates a load that creates resistance proportional to displacement (e.g., linear or rotational displacement) of an input to the displacement resistance unit. Preferably, as described herein in greater detail, one or more embodiments of the resistance system incorporate an inertial resistance unit and a displacement resistance unit and can utilize either or both of the resistance units. Thus, the terms "inertial" and "non-inertial" are used to describe the different resistance units for convenience in describing the illustrated embodiments; however, these terms can be replaced by "first" and "second" (and so on) throughout the disclosure to refer to any type of resistance unit other than the specific resistance unit shown.

In some configurations, one or both of the first resistance unit and the second resistance unit can comprise multiple modes of operation. For example, the first resistance unit, or inertial resistance unit, can have a first mode of operation in which the inertial load moves in the same direction as an input to the first resistance unit. In such an arrangement, the inertial load may undergo multidirectional (e.g., bidirectional) movement during normal operation of the resistance system. The first resistance unit can also have a second mode of operation in which the movement of the inertial load is unidirectional. In such an arrangement, the inertial load may be driven in response to movement of the input to the first resistance unit in a first direction and may not be driven in response to movement of the input in a second direction. In an additional mode, the inertial load may move in multiple directions in three-dimensional space in response to single, double or multiple directional input.

FIGS. 1-6 illustrate an embodiment of the present resistance system, which is generally referred to by the reference number 30. In the illustrated arrangement, the resistance system 30 is supported by and integrated with a frame assembly 32, which includes a base portion 34 and an upright portion 36. However, the frame assembly 32 may be of any suitable arrangement, which may be determined by the specific application in which the resistance system 30 is utilized or which may include components of the exercise machine or other structure in which the resistance system 30 is incorporated.

As described above, the resistance system 30 comprises a first resistance unit or inertial resistance unit 40 supported by the frame assembly 32. The inertial resistance unit 40 includes an inertial load, such as a rotatable flywheel 42 in the illustrated arrangement. The flywheel 42 can be constructed from a relatively heavy or dense material preferably concentrated away from its rotational axis such that the flywheel 42 has a relatively high mass-to-volume and rotational inertia-to-volume ratio. For example, flywheels 42 utilized for exercise equipment are often constructed from a cast iron material; however other suitable materials and construction methods can also be used. The flywheel 42 is rotatable about an axis A and creates a resistance force proportional to its rotational inertia or moment of inertia about the axis A. In an alternate configuration, both the first and the second (e.g., inertial 40 and non-inertial 50) resistance units can be supported by the same frame assembly 32 and/or base portion 34.

Optionally, the inertial resistance unit 40 can include an additional or supplemental resistance arrangement, which supplements the resistance provided by the rotational inertia of the flywheel 42. For example, in the illustrated arrangement, the inertial resistance unit 40 includes an electronic, magnetic or electromagnetic resistance mechanism 44, which is configured to selectively apply a force tending to inhibit rotation of the flywheel 42 thereby increasing the amount of resistance provided by the rotational inertia of the flywheel 42. The electronic, magnetic or electromagnetic resistance mechanism 44 can be manually, electronically or otherwise controlled to turn on or off (and apply or remove the additional force) and/or to select a level of a variable added resistance. An example of a suitable electronic, magnetic or electromagnetic resistance mechanism 44 and basic concepts of such an arrangement are disclosed, for example, in U.S. Pat. Nos. 4,775,145; 5,558,624; 5,236,069; 6,186,290 and U.S. Publication No. 2012/0283068, the entireties of which are hereby incorporated by reference herein. In addition, other suitable supplemental resistance arrangements can also be used, such as any suitable type of brake mechanism configured to apply a braking force to the flywheel 42. An example of a suitable brake is the CQ-38 brake produced by Hua Xing Machinery Company Ltd. of San He Kou, Dong Men, Chang Zhou City, China. In the present disclosure, the inertial resistance unit 40 includes a ring 44 as part of, or representative of, an electronic, magnetic or electromagnetic resistance system 44.

The resistance system 30 also includes a second resistance unit or a non-inertial resistance, which in the illustrated arrangement is a displacement resistance unit 50. Accordingly, the term "displacement resistance unit" is used for convenience in this disclosure and can also include any other type of non-inertial resistance units, unless indicated otherwise or made clear from the context of the disclosure. The displacement resistance unit 50 provides a resistance force proportional to a distance of displacement of an input to the displacement resistance unit 50. In the illustrated arrangement, the displacement resistance unit 50 comprises a biasing element, such as a linear coil spring 52. The spring 52 can be supported by the upright portion 36 of the frame assembly 32. In the illustrated arrangement, the upright portion 36 is a hollow tube and the spring 52 is partially or completely housed within the upright portion 36. However, in other arrangements, the spring 52 can be positioned in any other suitable location, supported by the frame assembly 32 or otherwise.

Although the illustrated displacement resistance unit 50 comprises a linear coil spring 52, other suitable resistance or biasing elements may be utilized. For example, other types of springs or spring-like elements may be used, such as torsion springs, elastic bands, bendable rods and gas cylinders, for example and without limitation. Moreover, other types of resistance elements or arrangements may be used, which may be displacement or non-displacement resistance (e.g., variable or constant resistance) arrangements, such as electronic, magnetic, electromagnetic (e.g., a motor or braking system) or fluid resistance arrangements. Furthermore, although weight stacks are not presently preferred due to the inconvenience caused by the often excessive weight necessary in many applications, in some applications it may be desirable to incorporate one or more weight stacks in the resistance unit 50.

The resistance system 30 preferably includes an input that is operably connected to one or both of the inertial resistance unit 40 and the displacement resistance unit 50. In the illustrated configuration, the input comprises a lever arm arrangement 60, which includes a lever arm 62 that is rotatable about a lever arm axis $A_L$. As described below, the lever arm 62 is capable of being coupled to both the inertial resistance unit 40 and the displacement resistance unit 50. Accordingly, movement of the lever arm 62 about the lever arm axis $A_L$, when coupled, results in actuation of the inertial resistance unit 40, the displacement resistance unit 50, both or neither. In the illustrated arrangement, movement of the lever arm 62 about the lever arm axis $A_L$, when coupled, results in movement of the flywheel 42 and/or the spring 52.

The illustrated lever arm 62 comprises a curved portion, which can be a portion of the length of the lever arm 62 or the entire length, or substantially the entire length, of the lever arm 62. Preferably, the curved portion of the lever arm 62 defines a circumferential arc relative to the axis A of the flywheel 42 such that each point on the curved portion is substantially the same distance from the axis A. In some configurations, the distance of the curved portion from the axis A differs by the corresponding amount of wrap or unwrap of the cable around the cable wrap pulley 114 to keep the effective cable length approximately the same. In the illustrated arrangement, a radius of the curved portion of the lever arm 62 is greater than a radius of the flywheel 42 such that the lever arm 62 is positioned radially outward of the circumferential edge of the flywheel 42. Although a curved lever arm 62 or a lever arm 62 having a curved portion is shown, other shapes may also be used, such as a straight lever arm, for example and without limitation. Such a straight lever arm could be angled downwardly from a rearward end, or pivot end, toward the forward end, or input end, or in any other orientation.

As described above, a rearward portion or rearward end of the lever arm 62 is supported for rotation about the lever arm axis $A_L$ by a pivot arrangement 64 supported by the upright portion 36 of the frame assembly 32. In the illustrated arrangement, the lever arm axis $A_L$ is located rearwardly of the upright portion 36 and approximately even with or above an uppermost point on the flywheel 42. The lever arm 62 initially extends upwardly from the lever arm axis $A_L$ and then curves downwardly forward of the axis A of the flywheel 42. A forward end or forward portion of the lever arm 62 is located forward of the flywheel 42 and, preferably, below the axis A of the flywheel 42. As described above, a straight version of the lever arm could maintain the same or approximately the same endpoints as the illustrated curved version and extend in a straight line between the end points, with the transmission incorporated along the cable.

The forward or free end of the lever arm 62 includes a coupler 66, which permits the lever arm 62 to be coupled to a user interface of the resistance system 30, which can be of any suitable arrangement, such as a cable-and-pulley system in a basic configuration or cardiovascular or strength training equipment in a more complex configuration, for example and without limitation. In the illustrated arrangement, the coupler is a U-bracket 66, which conveniently allows the resistance system 30 to be utilized with a simple cable-and-pulley system to which many types of handles can be assembled and which can be adjusted into a multitude of different vertical or horizontal positions. Moreover, the U-bracket 66 can permit the resistance system 30 to serve as a replacement for a weight stack, or other resistance device, commonly actuated by a cable-and-pulley system. The U-bracket 66 can support a pulley 68.

As described above, the lever arm 62 can be operably coupled to the inertial resistance unit 40 or the displacement resistance unit 50. The lever arm 62 can be coupled to the resistance units 40, 50 by any suitable arrangement or mechanism capable of transferring the movement of the lever arm 62 to the inertial resistance unit 40 and/or the displacement resistance unit 50. In the illustrated arrangement, the lever arm 62 carries an adjustment carriage 70, which is movable along the length of the lever arm 62 between at least first and second adjustment positions and supports a pulley 72. Preferably, the adjustment carriage 70 can be secured in a plurality of adjustment positions along the length of the lever arm 62. In the illustrated arrangement, the adjustment carriage 70 is secured to the lever arm 62 by a pop-pin arrangement in which a pin is spring-loaded or normally biased toward an engaged position such that, when aligned with one of a plurality of discrete recesses or holes, the pin is urged into engagement with the recess or hole. Alternatively, the adjustment carriage 70 can be infinitely adjustable, or otherwise adjustable, relative to the lever arm 62 with any suitable method.

Adjustment of the position of the adjustment carriage 70 on the lever arm 62 allows the effective lever arm length of the lever arm 62 to be adjusted. In particular, a linear displacement of the adjustment carriage 70 relative to the axis A for a given rotational displacement of the lever arm 62 can be adjusted by moving the adjustment carriage 70 along the lever arm 62. When the adjustment carriage 70 is closer to the lever arm axis $A_L$ the linear displacement of the adjustment carriage 70 relative to the axis A is less than when the adjustment carriage is moved further away from the lever arm axis $A_L$. As described further herein, such movement of the adjustment carriage 70 can adjust a resistance provided by at least the displacement resistance unit 50. As the adjustment carriage 70 moves further from the lever arm axis $A_L$ along the lever arm 62, the overall resistance will increase while the resistance curve supplied to the user can become increasingly lighter in the beginning of motion relative to the end of motion of the lever arm 62. This can allow the user to adjust the force curve during the range of motion of an exercise as desired Preferably, the resistance system 30 comprises a primary shaft 80, which is supported by the frame assembly 32, such as by a shaft housing or bracket 82. The shaft 80 is supported relative to the bracket 82 by at least one and preferably by a pair of suitable bearings 84 such that the shaft 80 is rotatable relative to the bracket 82. The flywheel 42 is supported on the shaft 80 by a suitable bearing assembly (not shown) such that the flywheel 42 is capable of rotation relative to the shaft 80.

The resistance system 30 also comprises a transmission assembly or transmission 90 that is operable to selectively couple the flywheel 42 for rotation with the shaft 80. The transmission 90 preferably comprises a one-way clutch arrangement 92 operably interposed between the shaft 80 and the flywheel 42 such that the shaft 80 drives the flywheel 42 in one rotational direction and does not drive the flywheel 42 in the opposite rotational direction. In other words, the one-way clutch arrangement 92 can apply a driving force to the flywheel 42 in one direction, but can allow the flywheel 42 to rotate faster than the shaft 80 in that direction or can allow the flywheel 42 to rotate in that direction when the shaft 80 is stationary. Any suitable one-way clutch mechanism can be used. One suitable example of a one-way clutch for use in exercise equipment is the HF2520 One Way Bearing sold by Boca Bearing Company of Boynton Beach, Fla.

In the illustrated arrangement, the transmission 90 permits a user to select a desired operating mode from at least two and preferably three separate operating or resistance modes, which for convenience are referred to herein as: 1) cardiovascular mode, 2) inertial mode, and 3) non-inertial mode. Preferably, as described further below, in all three modes rotation of the lever arm 62 in a first direction causes rotation of the shaft 80 in a first direction. The shaft 80 is coupled to the spring 52 and rotation of the shaft 80 in the first direction causes extension of the spring 52 against a resistance force exerted by the spring 52. When the lever arm 62 is rotated in a second direction, the shaft 80 rotates in a second direction, which allows the spring 52 to retract or reduce in length. Thus, in the illustrated arrangement, the spring 52 can be utilized to provide a return force to the lever arm 62 tending to rotate the lever arm 62 in the second direction. However, in other configurations, the spring 52 can be replaced with a bi-directional resistance source such that movement of the lever arm 62 in both the first and second directions is resisted. A typical cable can only be used in tension, not in compression. Therefore, such a configuration would preferably be designed specifically for bi-directional use (e.g., a cable loop from the transmission 90 attached to the moving end of the spring 52 coming from both directions of movement of the end of the spring 52, for example and without limitation).

In the cardio mode, the transmission 90 couples the flywheel 42 to the shaft 80 via the one-way clutch arrangement 92. Accordingly, in the cardio mode, rotation of the lever arm 62 in a first direction causes rotation of the shaft 80 in a first direction, which drives the flywheel 42 in a first direction via the one-way clutch arrangement 92. When the lever arm 62 is rotated in a second direction, the shaft 80 is also rotated in a second direction; however, the flywheel 42 is not driven by the rotation of the shaft 80 in the second direction because of the one-way clutch arrangement 92. Thus, the flywheel 42 is able to remain rotating in the first direction (assuming enough energy was transferred to the flywheel 42 during movement of the lever arm 62 in the first direction). As described above, the non-inertial or displacement resistance unit 50 (e.g., the spring 52) is also actuated in the cardio mode. In the cardio mode, a user can repeatedly cycle the lever arm 62 through a range of motion in the first direction and then the second direction, thereby repeatedly applying energy to the flywheel 42 at a desired cadence or frequency, which may be sufficient to obtain a cardiovascular workout. The additional resistance arrangement represented by ring 44 can be very useful in the cardio mode. With a proper interface, traditional cardio products can be used to cycle the lever arm allowing the resistance system 30 to be the resistance source for traditional cardio products. While all configurations can be suitable for this, configurations with 2 independently movable arms such as, but not limited to, the 3 lever arm configuration shown in FIGS. 16-18 can be particularly suitable for this.

In the inertial mode, the transmission 90 couples the flywheel 42 for rotation with the shaft 80 in both the first direction and the second direction. Accordingly, in the inertial mode, rotation of the lever arm 62 in the first direction causes rotation of the shaft 80 in the first direction, which drives the flywheel 42 in the first direction. When the lever arm 62 is rotated in the second direction, the shaft 80 is also rotated in a second direction, which drives the flywheel 42 in the second direction. Thus, the flywheel 42 rotates along with rotation of the shaft 80. As described above, the non-inertial or displacement resistance unit 50 (e.g., the spring 52) is also actuated in the inertial mode. This configuration provides an advantage of adding a traditional inertial (e.g., weight stack) feel to any non-inertial resistance source. In another configuration, in the inertial mode, a user can repeatedly cycle the lever arm 62 through a range of motion in the first direction, which is resisted by both the inertial resistance unit 40 and the non-inertial or displacement resistance unit 50, and then the second direction, which is resisted by the inertial resistance unit 40, but (in at least some embodiments) is assisted by the non-inertial or displacement resistance unit 50. In another configuration, an active, or driving, electronic or electromagnetic resistance (e.g., a motor) can be used to provide either additional or assistive resistance to either the inertial or non-inertial resistance units 40 or 50, respectively, in either a first or second direction or both. One result of this can be an increased resistance in the second direction over the first direction (e.g., increased negative resistance which can be useful for strength training). The active, or driving, electronic or electromagnetic resistance (e.g., a motor) can also be used as either the inertial or non-inertial resistance units 40 or 50, respectively, or both. A typical cadence or frequency of the cycling of the lever arm 62 in the inertial mode is often lower than the cadence or frequency utilized in the cardio mode due to the inertial resistance in both directions and may be useful for strength training, for example.

In the non-inertial mode, the transmission 90 does not fix the flywheel 42 to the shaft 80 or does not transfer motion of the lever arm 62 to the flywheel 42. Accordingly, rotation of the shaft 80 in either of the first direction and the second direction does not drive or otherwise result in driving rotation of the flywheel 42. However, as discussed above, the non-inertial or displacement resistance unit 50 (e.g., the spring 52) is actuated in the non-inertial mode and may provide all or substantially all of the resistance or assistance to movement of the lever arm 62. In particular, when the lever arm 62 is rotated in the first direction, the non-inertial or displacement resistance unit 50 (e.g., the spring 52) resists movement of the lever arm 62 and when the lever arm 62 is rotated in the second direction, the non-inertial or displacement resistance unit 50 (e.g., the spring 52) assists movement of the lever arm 62. However, in alternative arrangements, the non-inertial or displacement resistance unit 50 can be bi-directional and, thus, resist movement of the lever arm 62 in both directions.

Figure 2:
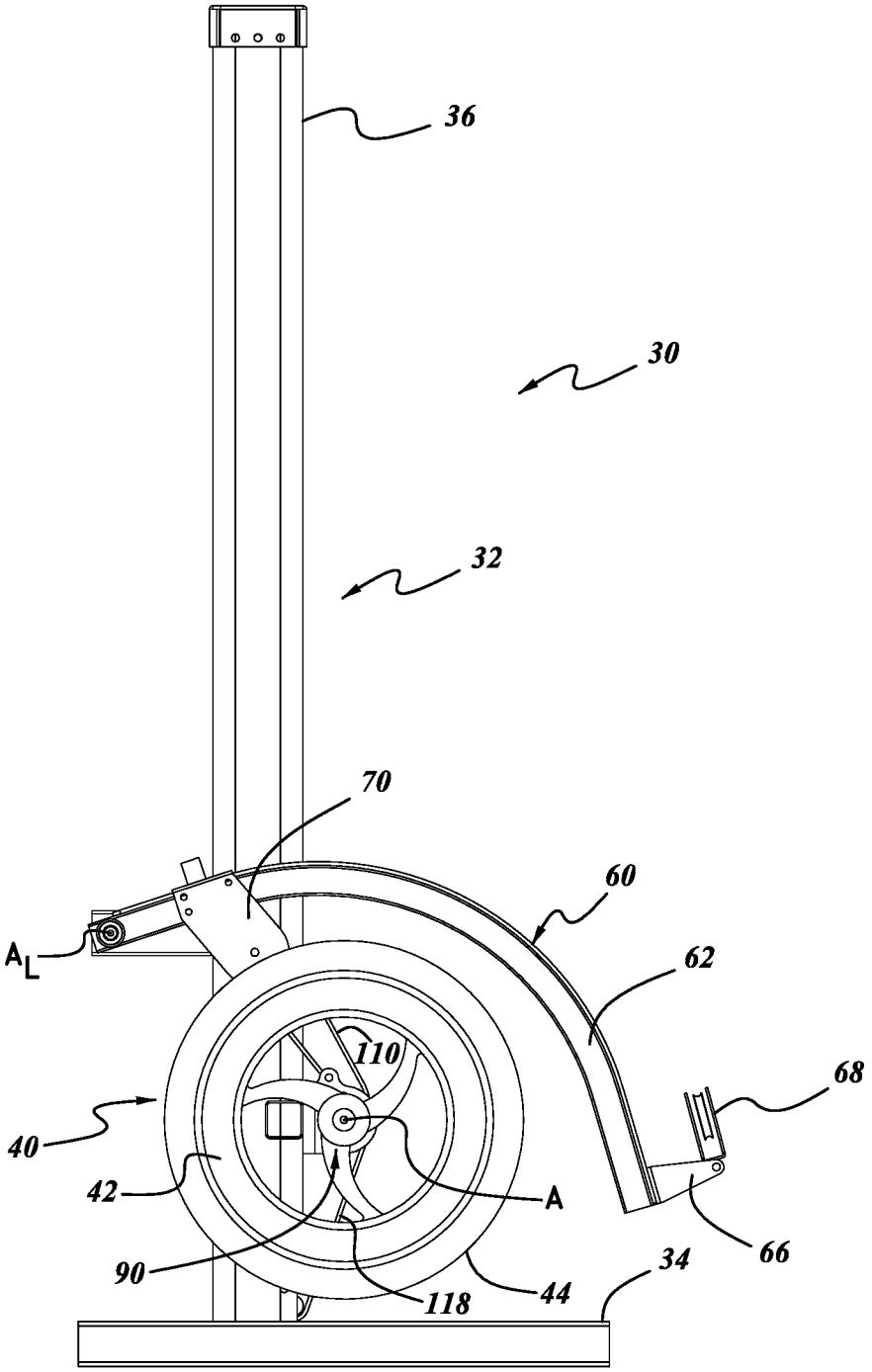
FIG. 2 is a side view of the resistance system of FIG. 1.
Figure 3:
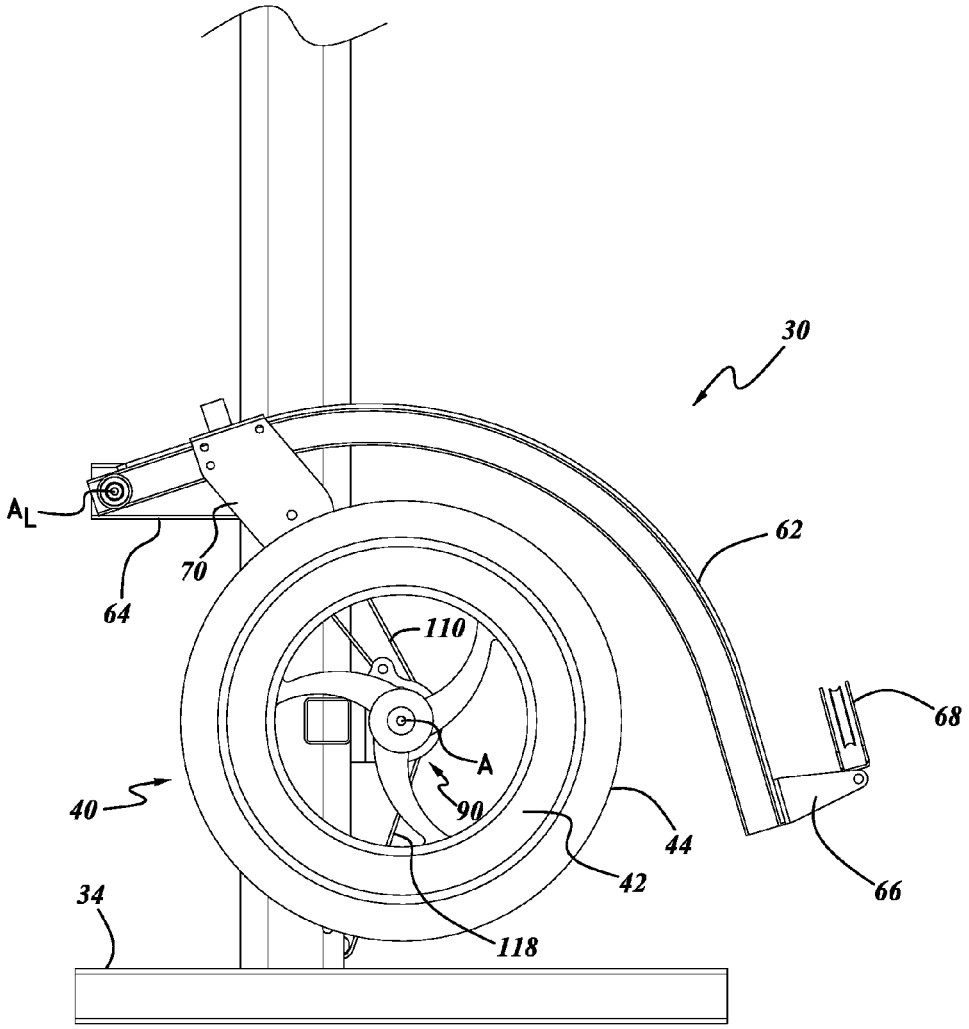
FIG. 3 is a side view of a portion of the resistance system of FIG. 1.
Figure 4:
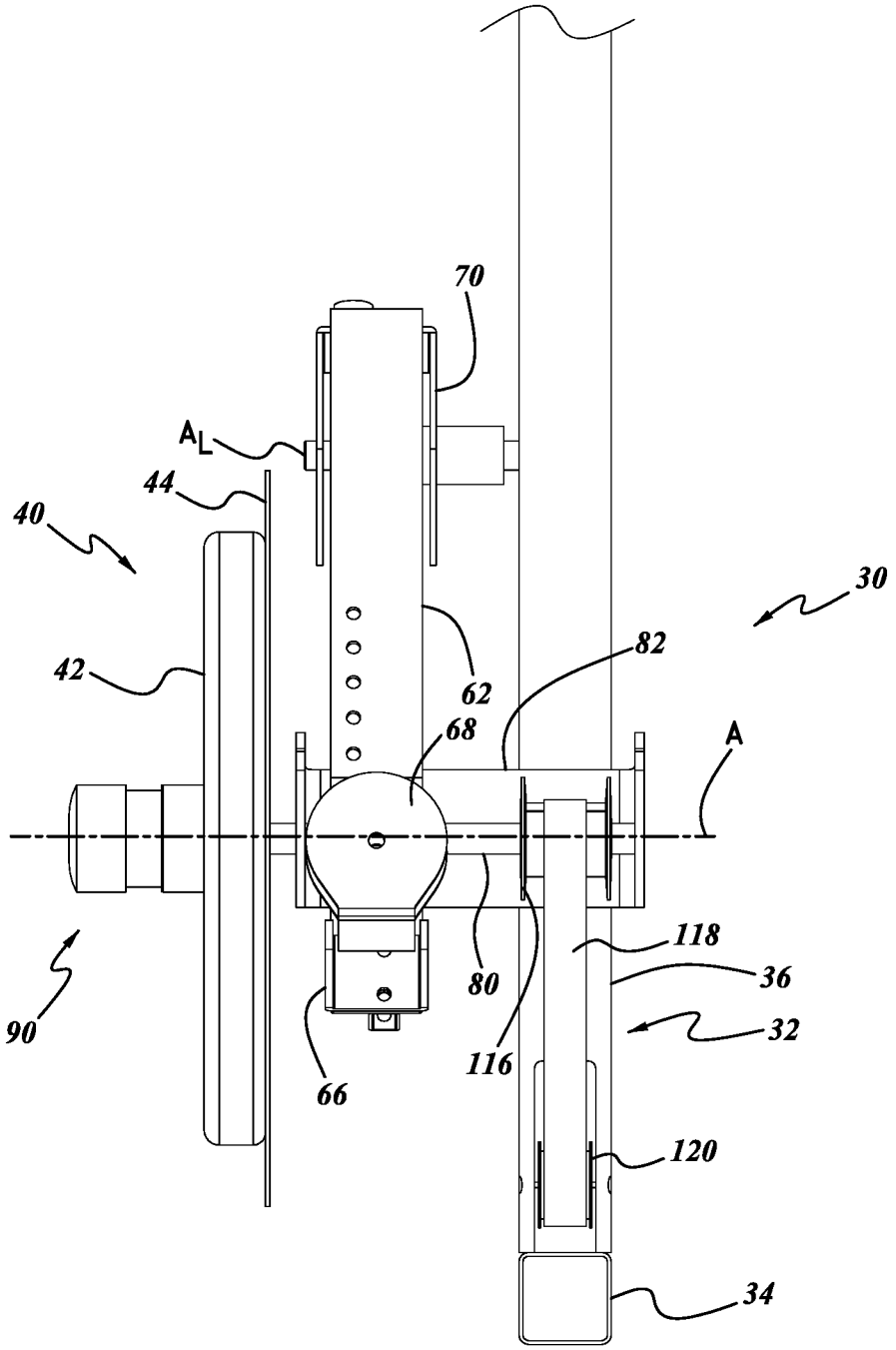
FIG. 4 is a front view of a portion of the resistance system of FIG. 1.
Figure 5:
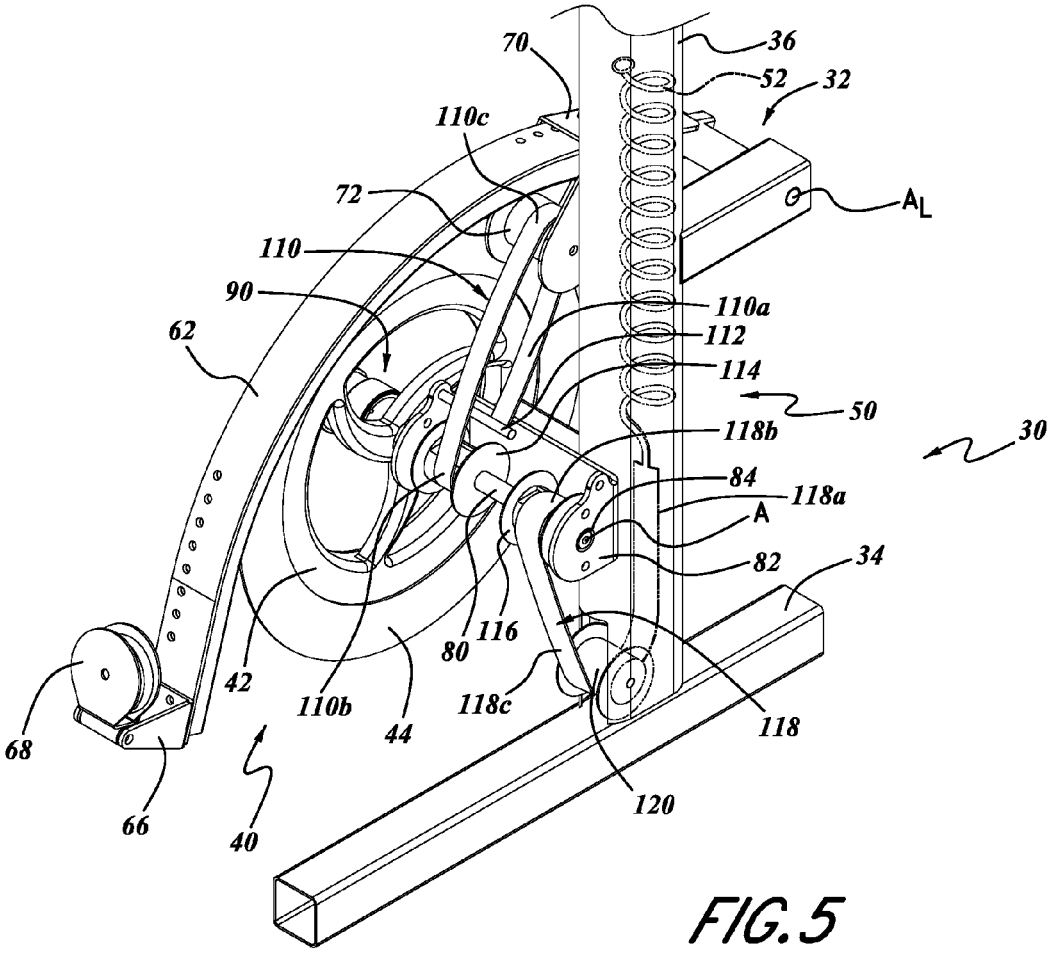
FIG. 5 is a perspective view of a portion of the other side and front of the resistance system of FIG. 1.
Figure 6:
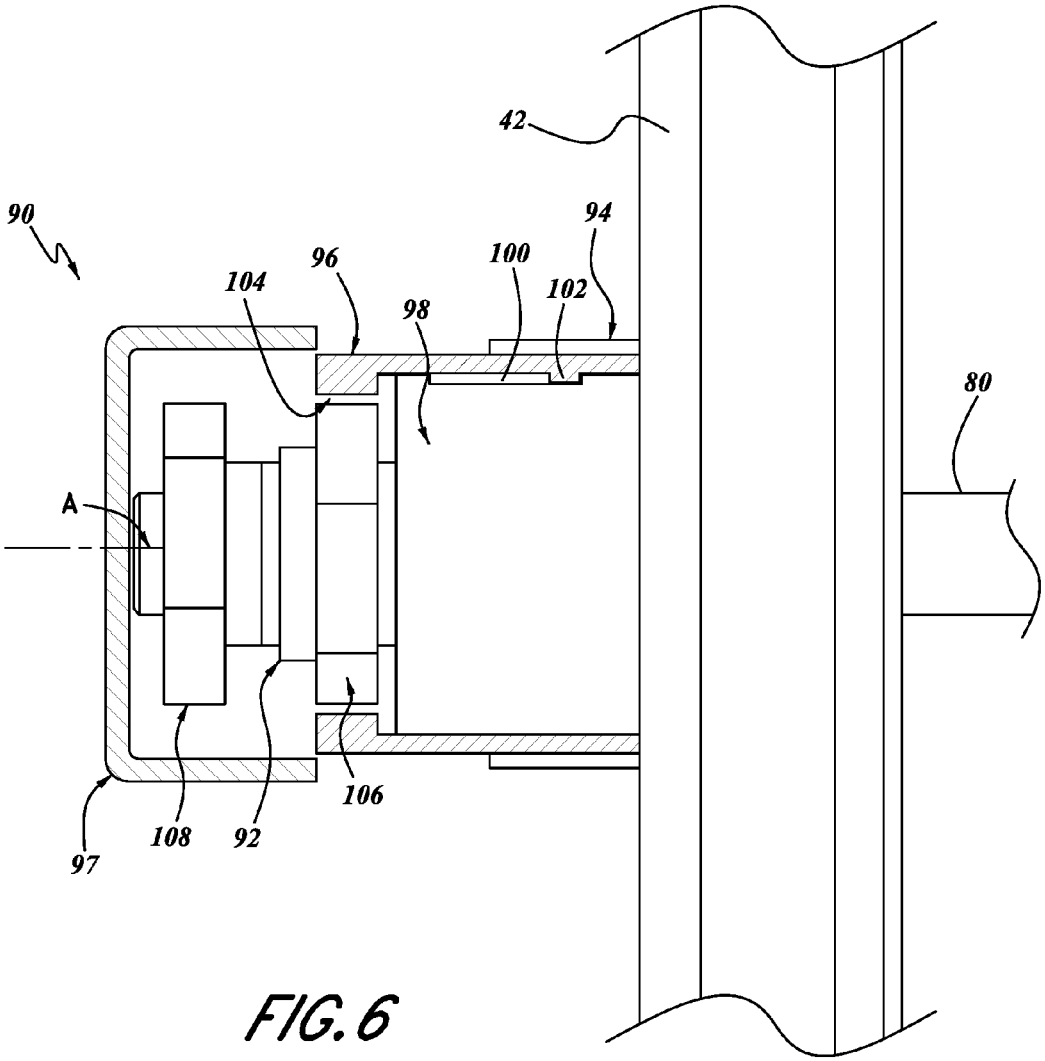
FIG. 6 is a partial cross-section of the resistance system of FIG. 1.

In the modes described above, the first direction of rotation of the lever arm 62 can be upward movement or counter-clockwise movement of the lever arm 62 about the lever arm axis $A_L$ relative to the orientation of FIG. 2 (viewing the flywheel 42 side). The second direction of rotation of the lever arm 62 can be downward or clockwise movement of the lever arm 62 about the lever arm axis $A_L$ relative to the orientation of FIG. 2, or opposite the first direction. However, in other arrangements, these directions could be reversed to better suit a particular application for the resistance system 30. The first and second rotational directions of the shaft 80 and flywheel 42 can be any suitable direction; however, it is preferred in at least one embodiment that the first direction of rotation of the shaft 80 causes extension of the spring 52 or is in the resistance direction of a unidirectional resistance element.

The transmission 90 can be of any suitable arrangement to selectively actuate the inertial resistance unit 40 and/or the non-inertial or displacement resistance unit 50 (as well as any other resistance units). In the illustrated arrangement, the transmission 90 comprises a mode selector body or gear engagement body, which can include a mode selector lock collar, or lock collar 94, and a mode selector gear collar, or gear collar 96. An end cap 97 may be provided to cover an outer end portion of the gear collar 96. The lock collar 94 and the gear collar 96 are coupled together and fixed for rotation with the flywheel 42, but are axially movable relative to the flywheel 42 along the flywheel axis A. Preferably, the gear collar 96 is keyed to a hub portion 98 of the flywheel 42 by any suitable arrangement, such as a groove 100 and key 102 arrangement, for example and without limitation. Although described with individual names, the lock collar 94 and the gear collar 96 can be portions of a unitary component, can be separate components of an integrated assembly or can be individual components that are linked for movement together in at least one direction, among other suitable arrangements.

In one arrangement, the gear collar 96 is keyed to the hub portion 98 of the flywheel 42 for axial but not rotational movement with respect to the flywheel. The lock collar 94 goes over the gear collar 96 engaging and disengaging a ball and spring detent (not shown) which is used to hold the axial position of the gear collar 96 with respect to the flywheel 42. The gear collar 96 comprises an engagement or drive portion 104 that is configured to drivingly engage a first gear 106 or a second gear 108 of the transmission 90. Preferably, the gear collar 96 engages only one of the first gear 106 or the second gear 108 at a time. In the illustrated arrangement, the engagement portion 104 comprises an engagement surface that defines a non-circular opening circumscribing the axis A. The engagement portion 104 can be the same shape as the gears 106 and 108 or can be a complementary shape that is capable of drivingly engaging the gears 106 and 108. In the illustrated arrangement, the non-circular opening of the engagement portion 104 is in the shape of a polygon, such as a hexagon for example and without limitation. However, other suitable number of sides or engagement surfaces can be provided (e.g., 2, 3, 4, 5, 6, 7, 8, 9, 10 or more). In some configurations, the engagement portion 104 and/or the gears 106 and 108 have other suitable shapes, such as a toothed gear or spline arrangement, for example and without limitation.

Preferably, the first gear 106, which can also be referred to as a cardio gear or one-way gear, is coupled to the shaft 80 via the one-way clutch arrangement 92. Accordingly, in some configurations, the shaft 80 drives the first gear 106 in only one direction. The gear collar 96 can be positioned in a first axial position to engage the first gear 106, which can correspond to the cardio mode of the resistance unit 30, as described above. In the first position, rotation of the shaft 80 in the first direction is transferred to the flywheel 42 via the one-way clutch arrangement 92, the first gear 106 and the gear collar 96, which drivingly engages the hub portion 98 of the flywheel 42.

The second gear 108, which can also be referred to as an inertial gear or fixed gear, preferably is coupled directly to the shaft 80 or for direct rotation by the shaft 80 in both directions. That is, no one-way clutch mechanism is interposed between the shaft 80 and the second gear 108. The gear collar 96 can be positioned in a second axial position to engage the second gear 108, which can correspond to the inertial mode of the resistance unit 30, as described above. In the second position, rotation of the shaft 80 in either of the first direction or the second direction causes a corresponding rotation of the flywheel 42 via the second gear 108 and the gear collar 96, which drivingly engages the hub portion 98 of the flywheel 42.

The gear collar 96 can also be positioned in a third axial position in which it does not engage either of the first gear 106 or the second gear 108, which can correspond to the non-inertial mode, as described above. In the illustrated configuration, the third position of the gear collar 96 locates the engagement portion 104 between the first gear 106 and the second gear 108. In the third position of the gear collar 96, rotation of the shaft 80 in either direction is not transmitted to the flywheel 42.

In the illustrated arrangement, when driven, the flywheel 42 is driven at the same rotational velocity or speed as the shaft 80. However, in other arrangements, a gear ratio transmission can be set up such that the flywheel 42 rotates at a speed different from the speed of the shaft 80. For example, in some applications, it may be desirable for the flywheel 42 to rotate faster than the shaft 80 to increase the inertial resistance. However, in other arrangements, the flywheel 42 may be configured to rotate slower than the shaft 80. Any suitable gear ratio transmission can be used, such as any type of gears, pulleys, sprockets, etc.

As described above, the shaft 80 preferably is operably coupled to the lever arm 62 and the non-inertial or displacement resistance unit 50 (e.g., spring 52). In the illustrated arrangement, the lever arm 62 acts as an input to the resistance system 30 and, thus, as an input to the shaft 80. Accordingly, motion (e.g., rotation) of the lever arm 62 is converted into motion (e.g., rotation) of the shaft 80. Any suitable motion transfer mechanism can be used, including, but not limited to, variable belt drives and gear systems. In the illustrated arrangement, a flexible, first elongate member 110 (e.g., a belt or cable) extends between at least the lever arm 62 and the shaft 80. Preferably, a first end 110*a* of the first elongate member 110 is secured to a fixed or fixable location, such as an anchor or belt (or cable) attachment 112. A second end 110*b* of the first elongate member 110 is wrapped around and preferably secured to a first pulley 114, which is fixed for rotation with the shaft 80. An intermediate portion 110*c* of the first elongate member 110 extends around the pulley 72.

With such an arrangement, rotation of the lever arm 62 changes the linear distance between the pulley 72 and the axis A. The change in linear distance changes an effective length of the first elongate member 110 and results in wrapping or unwrapping of the elongate member 110 on the first pulley 114, thereby causing rotation of the shaft 80 in one of the first and second directions. In the illustrated arrangement, upward movement of the lever arm 62 causes the first elongate member 110 to unwrap on the first pulley 114, which results in rotation of the shaft 80 in the first direction. Downward movement or lowering of the lever arm 62 allows the first elongate member 110 to wrap onto the first pulley 114. Preferably, the non-inertial or displacement resistance unit 50 (e.g., spring 52) tends to rotate the shaft 80 in the second direction to assist the first elongate member 110 in re-wrapping on the first pulley 114. However, in other arrangements a separate return member, such as a return spring, can be used.

A second pulley 116 preferably is fixed for rotation with the shaft 80. A flexible, second elongate member 118 (e.g., a belt or cable) has a first end 118*a* coupled to the non-inertial or displacement resistance unit 50 and, in particular, to the spring 52. A second end 118*b* of the second elongate member 118 is wrapped around and preferably secured to the second pulley 116. An intermediate portion 118*c* of the second elongate member 118 extends around a pulley 120 that is supported by the frame assembly 32. With such an arrangement, rotation of the shaft 80 causes the second elongate member 118 to wrap or unwrap on the second pulley 116. Rotation of the shaft 80 in the first direction causes the second elongate member 118 to wrap onto the second pulley 116, which reduces the effective length of the second elongate member 118 and causes extension of the spring 52. The biasing force of the spring 52 tends to unwrap the second elongate member 118 from the second pulley 116, which, in the absence of a resisting force sufficient to overcome the force of the spring 52, causes the shaft 80 to rotate in the second direction. Although pulleys 114, 116 and flexible elongate members 110, 118 (e.g., belts or cables) are illustrated, other suitable mechanisms for transferring motion between the lever arm 62, shaft 80 and non-inertial or displacement resistance unit 50 (e.g., spring 52) can also be used. In addition, although separate pulleys 114, 116 are shown, other suitable arrangements can also be used, such as one long pulley, for example.

In operation of the illustrated resistance system 30, a user can select a desired mode of operation from the available modes of operation (e.g., cardio mode, inertial mode and non-inertial mode) by, for example, using a selector, such as the gear collar 96 and/or lock collar 94 of the transmission 90. The user can further select a desired resistance level by, for example, altering the position of the adjustment carriage 70 on the lever arm 62. The user can then utilize the resistance system 30 by moving the lever arm 62 about the lever axis $A_L$ utilizing any suitable input or interface, such as a cable-and-pulley system or other piece of exercise equipment, for example. In some configurations, the non-inertial resistance unit 50 can be disconnected from the lever arm 62 such that only the inertial resistance unit 40 is utilized. For example, the second pulley 116 can be disconnected from the shaft 80 by any suitable mechanism, which can be actuated by the transmission 90.

Figure 7:
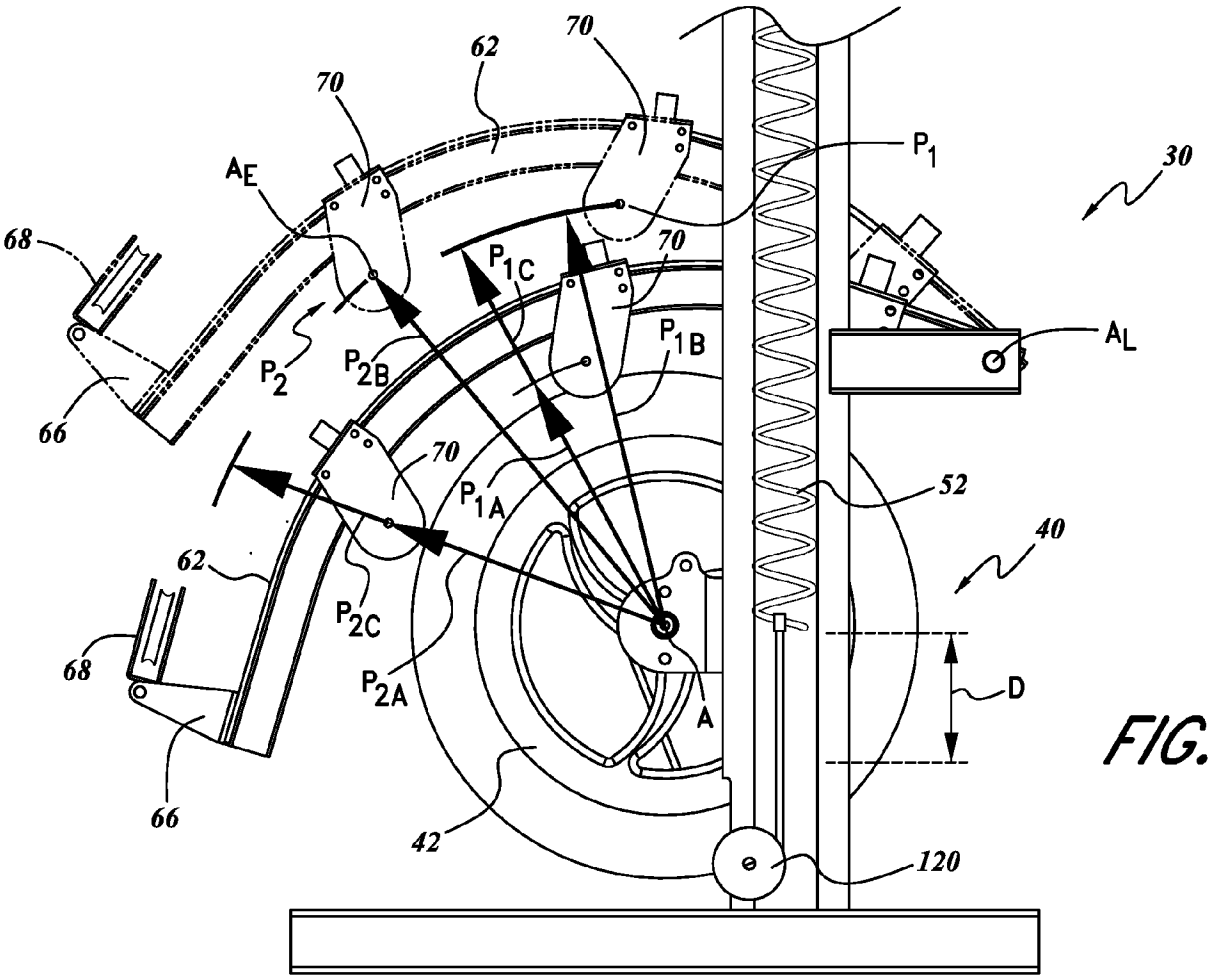
FIG. 7 is a side view of a resistance system illustrating a lever arm in two positions and an adjustment carriage in two positions on the lever arm.
Figure 8:
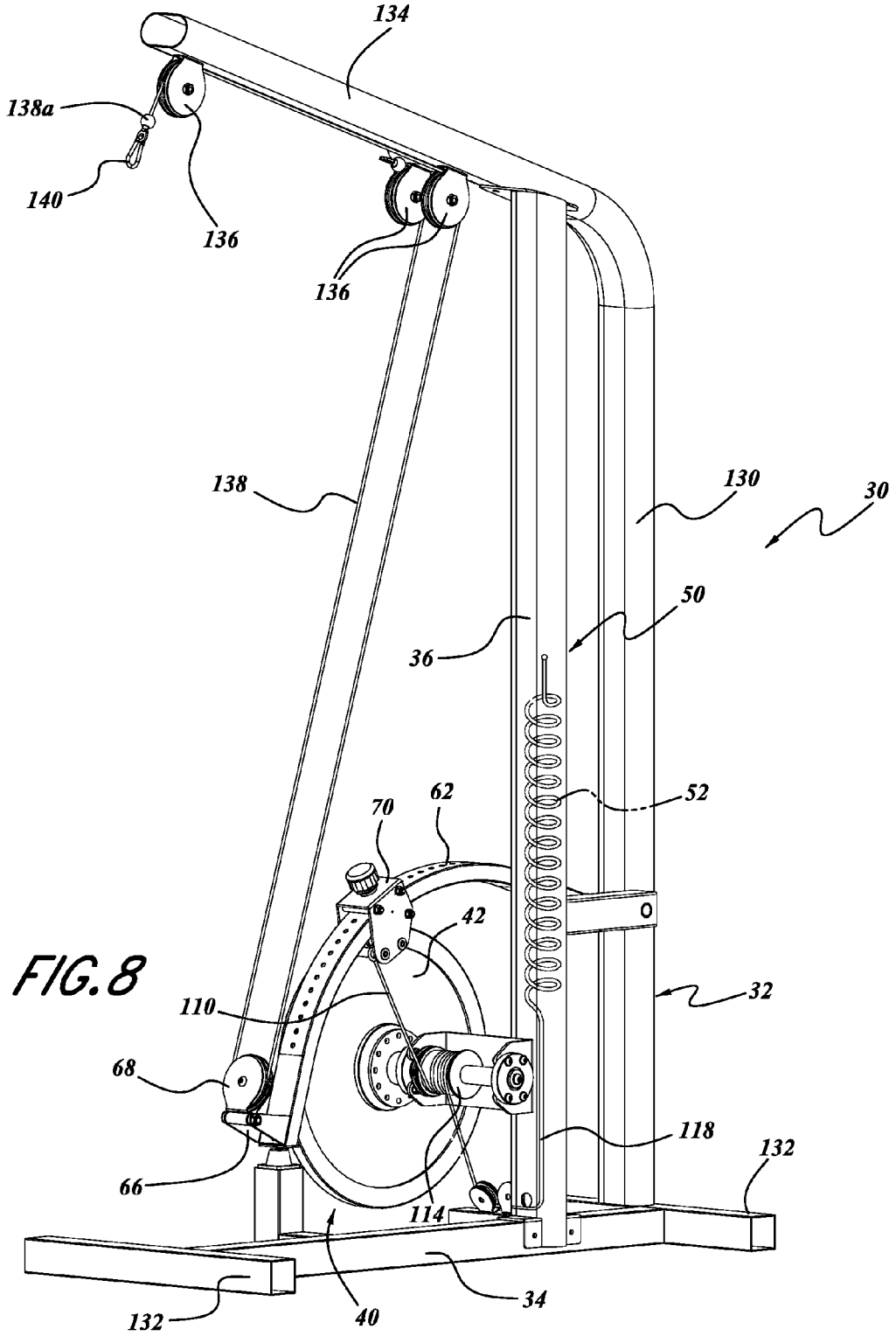
FIG. 8 is a perspective view of a side and front of another resistance system.
Figure 9:
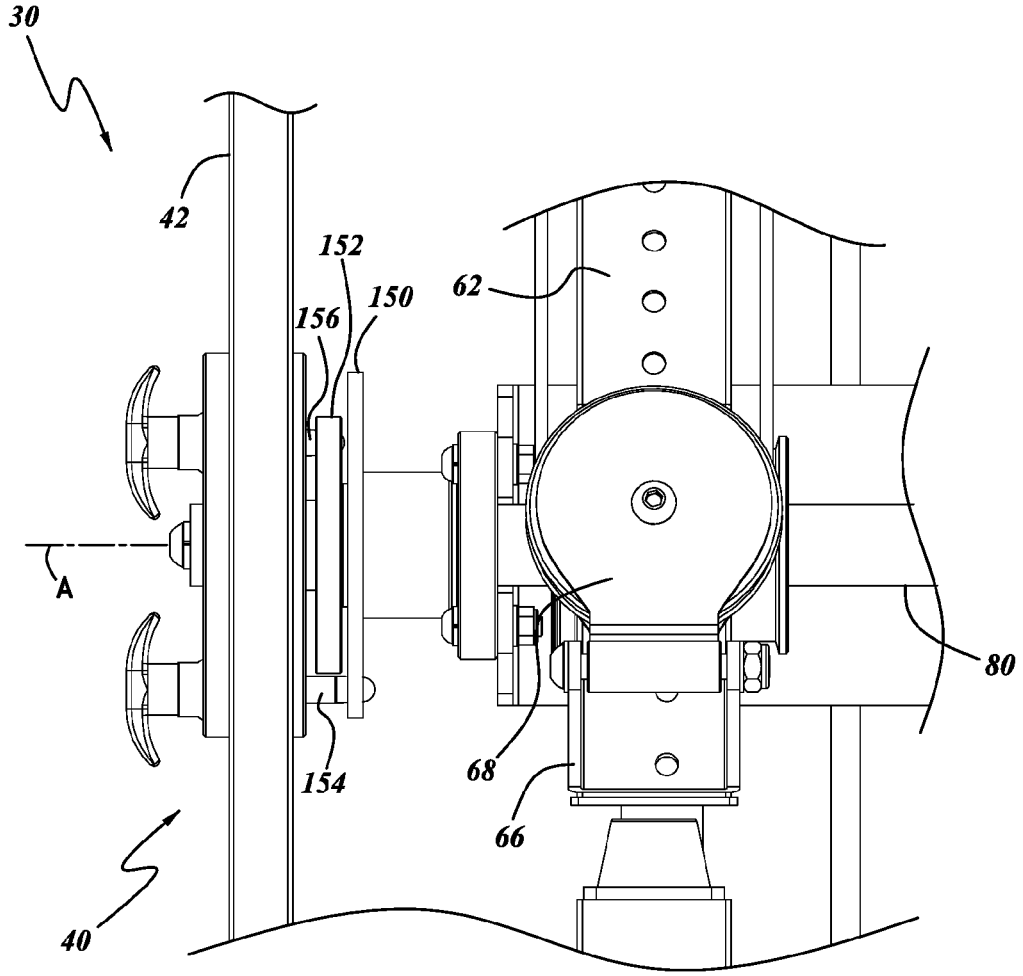
FIG. 9 is a front view of a portion of the resistance system of FIG. 8.
Figure 10:
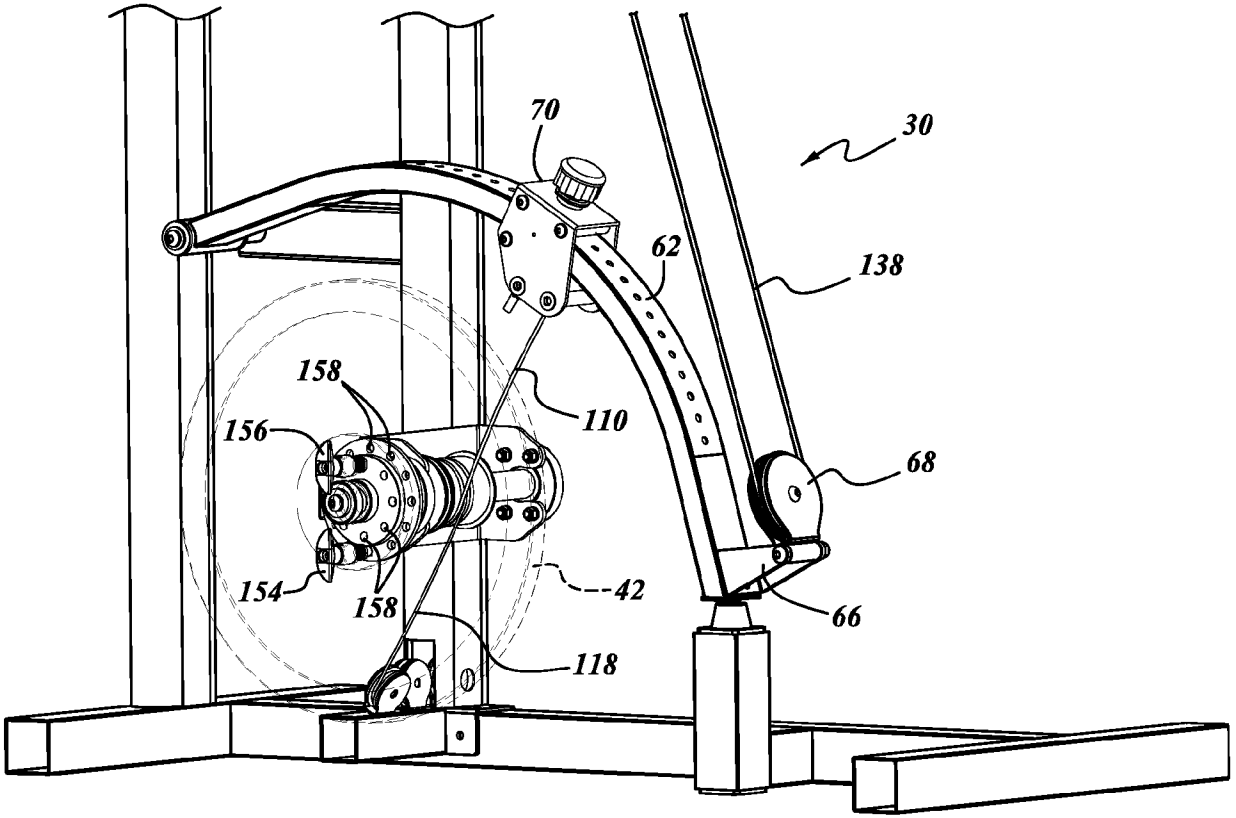
FIG. 10 is a perspective view of the other side and front of the resistance system of FIG. 8 with a portion of a flywheel of the resistance system cut away to show structure behind the flywheel.
Figure 11:
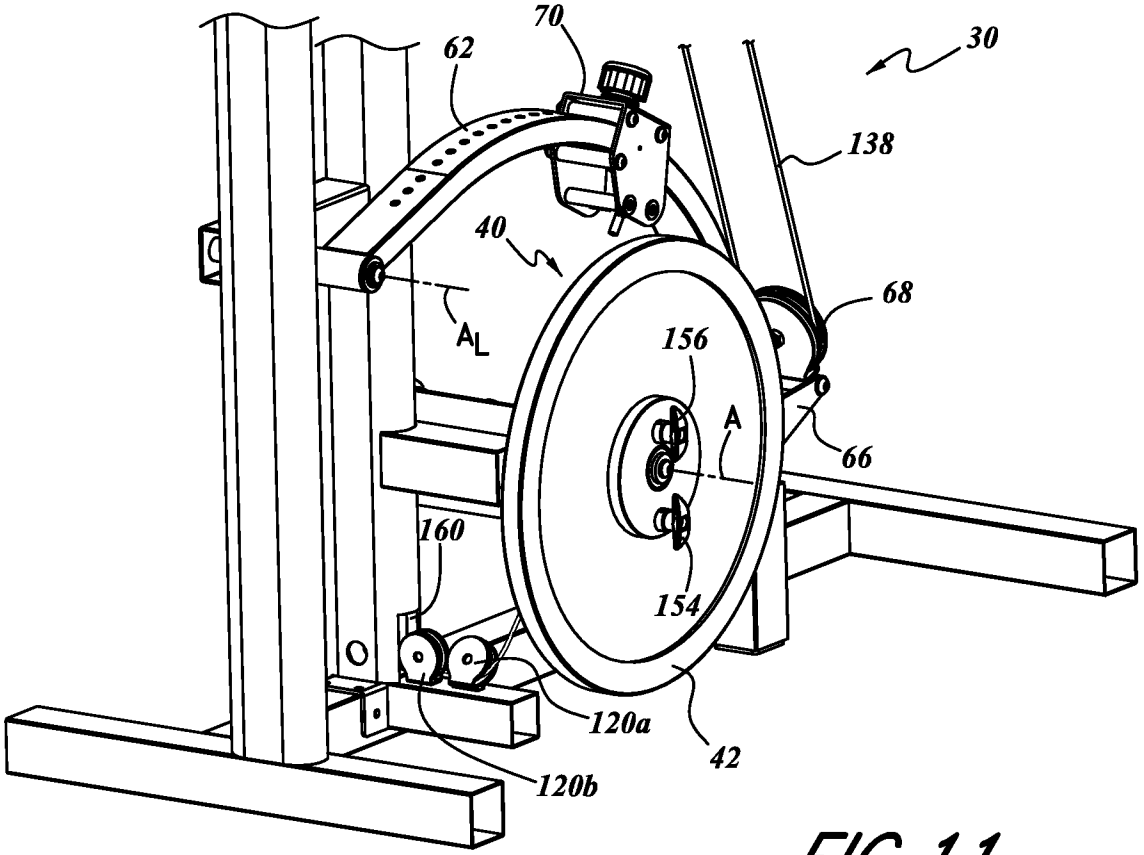
FIG. 11 is a perspective view of a back and side of the resistance system of FIG. 8.

With reference to FIG. 7, an effect of the adjustment of the adjustment carriage 70 on the lever arm 62 is illustrated. The adjustment carriage 70 is shown in two possible adjustment positions: a first position P1 and a second position P2. The first position P1 is closer to the lever arm axis $A_L$ than the second position P2. The lever arm 62 is shown in two different positions within its range of motion, one in solid line (lowered position) and one in dashed line (raised position). Preferably, the displacement D of the spring 52 (or other non-inertial resistance load of the non-inertial resistance unit 50) is related to the rotational distance or number of rotations of the shaft 80. In addition, the rotational distance or number of rotations of the shaft 80 is related to a change in the linear distance between the axis A of the shaft 80 and an axis $A_P$ of the pulley 72 in two different positions of the lever arm 62 (e.g., the lowered position and the raised position).

In the first position P1 of the adjustment carriage 70, a first linear distance between the axis A and the pulley axis $A_P$ with the lever arm 62 in the lowered position is represented by the line $P1_A$ and a second linear distance with the lever arm 62 in the raised position is represented by $P1_B$. The second linear distance $P1_B$ is greater than the first linear distance $P1_A$. A difference between the second linear distance $P1_B$ and the first linear distance $P1_A$ is represented by the line $P1_C$. Similarly, in the second position P2 of the adjustment carriage 70, a first linear distance between the axis A and the pulley axis $A_P$ with the lever arm 62 in the lowered position is represented by the line $P2_A$ and a second linear distance with the lever arm 62 in the raised position is represented by $P2_B$. The second linear distance $P2_B$ is greater than the first linear distance $P2_A$. A difference between the second linear distance $P2_B$ and the first linear distance $P2_A$ is represented by the line $P2_C$. Because the adjustment carriage 70 is further from the lever arm pivot axis $A_L$ in the second position P2 than the first position P1, the distance $P2_B$ is greater than the distance $P1_B$. As a result, the rotational distance or number of rotations of the shaft 80 is greater between the lowered position and the raised position of the lever arm 62 with the adjustment carriage 70 in the second position P2 than in the first position P1. Accordingly, the displacement D of the spring 52 is greater between the lowered position and the raised position of the lever arm 62 with the adjustment carriage 70 in the second position P2 than in the first position P1, which results in a greater total resistance force from the spring 52 in the second position P2 than in the first position P1 for a given movement of the lever arm 62. This greater total resistance force is also applied at a point of greater leverage (further from the lever arm axis $A_L$) along the lever arm 62, resulting in further increased resistance to the upward movement of lever arm 62. These differences in resistance force and in the distance between P2*b* and P1*b* for a single portion of first elongate member 110 going between pulley 114 and adjustable carriage 70 can be multiplied by having more portions of first elongate member 110 going between pulley 114 and its support structure and adjustable carriage 70.

FIGS. 8-11 illustrate another version of the resistance system 30, which in many respects is similar to the system 30 of FIGS. 1-6. Accordingly, reference numbers are reused to indicate general correspondence between reference elements or features. In addition, the disclosure herein is primarily directed toward the differences between the two systems 30. Therefore, any elements or features of the system 30 of FIGS. 8-11 not described in detail can be assumed to be the same as or similar to the corresponding elements or features of the system 30 of FIGS. 1-6, other systems 30 described herein, or can be of any other suitable arrangement.

The frame assembly 32 preferably includes a second upright portion 130 in addition to the first upright portion 36. In addition, the frame assembly 32 can include a pair of lateral supports 132 attached at opposite ends (e.g., fore and aft) of the base portion 34. Furthermore, preferably, the frame assembly 32 comprises an overhead or upper support arm 134, which can extend from one or both of the first upright portion 36 and the second upright portion 130 in the same direction as the lever arm 62 or in a forward direction. The upper support arm 134 can support a plurality of pulleys 136 through which a cable 138 can be routed to act as an input to the resistance system 30. An end 138*a* of the cable 138 can include a clip, carabiner or other connector 140, which permits the cable 138 to be coupled to a user interface, such as a handle, bar, grip, additional cable-and-pulley arrangement, or any other exercise device.

The system 30 of FIGS. 8-11 includes a modified transmission 90 relative to the system 30 of FIGS. 1-6. In particular, at least a portion of the transmission 90 is located on an inboard side of the flywheel 42 (or on the slide of the flywheel 42 nearest the frame assembly 32 and/or lever arm 62. Preferably, the connection between the flywheel 42 and the shaft 80 is located on the inboard side of the flywheel 42. Such an arrangement can result in a more compact layout by better utilizing available space on the inboard side of the flywheel 42 or between the flywheel 42 and the frame assembly 32, for example.

The illustrated transmission 90 includes a first plate 150 and a second plate 152, each of which can be respectively coupled to the flywheel 42 by an engagement element, such as a first pin 154 and a second pin 156. Preferably, the pins 154 and 156 are carried by, or are rotatable with, the flywheel 42. The pins 154 and 156 are each axially movable with respect to the flywheel 42 between an engaged position in which the pin 154 or 156 engages the plate 150 or 152, respectively, and a disengaged position in which the pin 154 or 156 does not engage the plate 150 or 152, respectively. The pins 154 and 156 can be manually movable (directly or indirectly) or automatically movable (e.g., via a motor and electronic control). Moreover, the transmission 90 can be arranged such that only one pin 154 or 156 can be engaged with its respective plate 150 or 152 at a time.

The plates 150 and 152 preferably are of different diameters and the pins 154 and 156 are positioned at different radial distances from the axis A. Accordingly, the respective pin 154 can engage the plate furthest from the flywheel 42 (the first plate 150 in the illustrated arrangement) without interfering with the plate closest to the flywheel 42 (the second plate 152 in the illustrated arrangement). That is, preferably, the first pin 154 is positioned radially outward of the second plate 152. Each plate 150, 152 preferably includes a plurality of openings or engagement holes 158 for engagement with the respective pin 152, 154. Therefore, the holes 158 of the first plate 150 are positioned radially outward of a peripheral edge of the second plate 152 and, thus, radially outward of the holes 158 of the second plate 152. The provision of a plurality of holes 158 allows easy access to the nearest hole 158 regardless of the position of the flywheel 42. That is, the flywheel 42 will only need to be rotated a relatively small angular displacement to align the desired pin 154 or 156 with a hole 158 of the respective plate 150 or 152. Suitable methods other than pins engaging holes can also be used.

The resistance system 30 of FIGS. 8-11 utilizes cables (or cable portions) 110 and 118 instead of the belts of the system 30 of FIGS. 1-6. The cable 110 can wrap around the pulley 114 such that individual loops of the cable 110 can be positioned side-by-side along an axial length of the pulley 114 in contrast to the belt, in which the individual loops can lie on top of one another in an axial direction of the pulley 114 and building up outwardly in a radial direction from an axis of the pulley 114. In the illustrated arrangement, the lever arm 62 is linked to the non-inertial or displacement resistance unit 50 through a single cable (or other motion transfer element), which also engages the pulley 114. Thus, the single cable can have a portion 110 that extends from the pulley 114 to the lever arm 62 and another portion 118 that extends from the pulley 114 to the non-inertial or displacement resistance unit 50. The pulley 116 of the system 30 of FIGS. 1-6 can be omitted. In addition, the pulley 120 is replaced with a pair of pulleys 120*a* and 120*b* and the cable 118 accesses the end of the spring 52 (or other non-inertial or displacement load of the non-inertial or displacement resistance unit 50) via an opening 160 in a side of the first upright portion 36 (however, the spring 52 or other load could also be housed within the second upright portion 130 or any other suitable locations, such as a dedicated housing). In the illustrated arrangement, one pulley 120*a* is angled or tilted such that a plane in which the pulley 120*a* lies intersects or passes near the axis A of the shaft 80 or the perimeter of the pulley 114. The other pulley 120*b* can lie in a substantially vertical plane or a plane in which an axis of the spring 52 lies.

Figure 12:
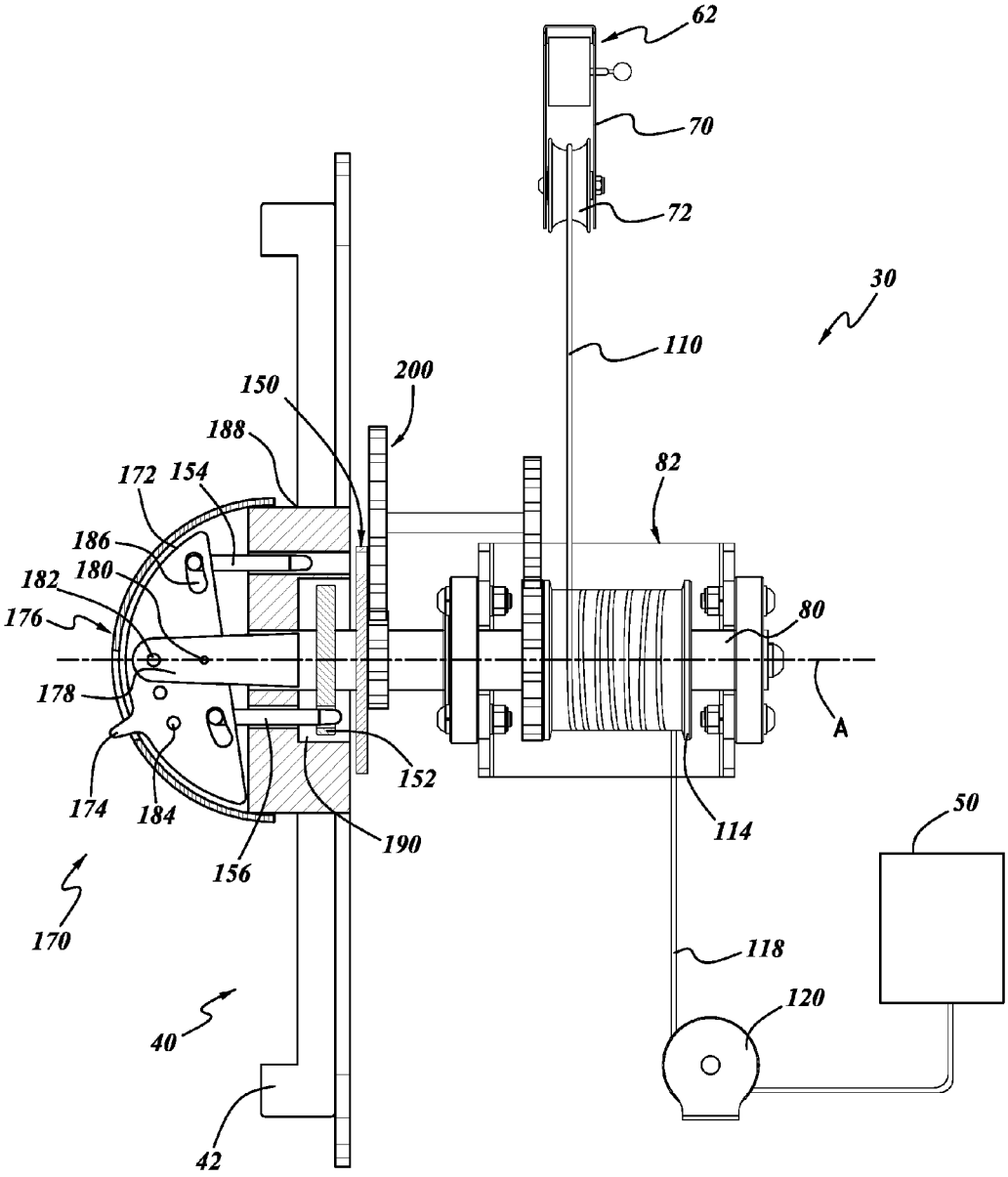
FIG. 12 is a schematic, cross-section of a modification of the resistance system of FIG. 8.

FIG. 12 illustrates another version of the resistance system 30, which in many respects is similar to the systems 30 of FIGS. 1-6 and FIGS. 8-11. Accordingly, reference numbers are reused to indicate general correspondence between reference elements or features. In addition, the disclosure herein is primarily directed toward the differences in the system 30 of FIG. 12 relative to the other systems 30 described herein. Therefore, any elements or features of the system 30 of FIG. 12 not described in detail can be assumed to be the same as or similar to the corresponding elements or features of the other systems 30 described herein, or can be of any other suitable arrangement.

In the system 30 of FIG. 12, the pins 154 and 156 are driven through a selection arrangement or selector 170 instead of being directly manipulated by a user of the resistance system 30. The selector 170 includes a pin driver, which is also referred to as an actuator 172. The actuator 172 includes a user interface, such as a handle or lever 174, which permits a user to adjust the actuator 172 to a desired one of an available number of positions. The selector 170 can include a housing, such as a cover or end cap 176, that encloses a portion of the actuator 172, but permits access to the lever 174. The actuator 172 is supported by a support, such as a bracket 178, for rotation about an adjustment axis, which can be defined by a shaft, axle or pin 180. A detent arrangement 182 can be provided to provide tactile feedback to a user with respect to the position of the actuator 172. Preferably, the bracket 178 carries a biased engagement member (e.g., a ball and spring) that is capable of engaging one of a plurality of recesses or openings 184 on the actuator 172 that correspond to one of the available positions of the actuator 172 and one of the available modes of the resistance system 30.

The pins 154 and 156 can be driven by the actuator 172 by any suitable arrangement. Preferably, the actuator 172 includes a slot 186 for each of the pins 154 and 156. Each slot 186 defines a cam surface that engages a portion of its respective pin (or a related component, such as a cam follower) such that rotational motion of the actuator is converted into linear motion of the pins 154 and 156, preferably in a direction along or parallel to the axis A. The pins 154 and 156 can be supported or constrained for linear motion by a pin support body, which is in the form of a hub 188 in the illustrated arrangement. The hub 188 is fixed for rotation with the flywheel 42 about the axis A and relative to the shaft 80. The hub 188 can be a separate component from or can be integral or unitary with the flywheel 42.

The pins 154 and 156 are arranged in a similar manner to those shown and described in connection with FIGS. 8-11, with one pin (e.g., pin 154) positioned at a radial distance from the axis A that is different from that of the other pin (e.g., pin 156). In the illustrated arrangement, the pin 154 is positioned at a radial distance from the axis A that is greater than that of pin 156. Preferably, the pins 154 and 156 are located on opposite sides of the pivot axis of the actuator 172, as defined by the pin 180, such that the pins 154 and 156 are moved in opposite axial directions relative to one another upon rotational movement of the actuator 172. With such an arrangement, one pin 154 or 156 is moved in an engaging direction while the other pin 154 or 156 is moved in a disengaging direction when the actuator 172 is rotated. Preferably, the actuator 172 has at least three positions, which places the pins 154 and 156 in three different positions corresponding to the modes (cardio, inertial and non-inertial) as described above.

The system 30 of FIG. 12 includes a first plate 150 coupled to the shaft 80 through a one-way clutch arrangement 92 (not shown in FIG. 12) and a second plate 152 coupled for rotation with the shaft 80. The pins 154 and 156 engage openings 158 in a respective one of the first plate 150 and the second plate 152. In some configurations, the second plate 152 can be received partially or completely within a recess 190 of the hub 188. The first plate 150 can be located axially outside of the hub 188.

FIG. 12 also illustrates a gear ratio transmission 200 that transfers motion from the pulley 114 to the first plate 150, which can create a difference in a speed or rotational velocity between the pulley 114 and the first plate 150. In this configuration, the one-way clutch can be incorporated in the gear ratio transmission 200 rather than the first plate 150 which would just have a regular bearing for rotation about shaft 80. Accordingly, in such an arrangement, the pulley 114 is fixed for rotation directly with the shaft 80, but through the transmission 200, the first plate 150 rotates at a higher or lower rate than shaft 80 based on the design of gear ratio transmission 200. This higher or lower rate of rotation is transferred to the flywheel 42 when first plate 150 is engaged by pin 154 when the cardio mode is selected. The illustrated transmission 200 uses gears to transfer motion; however, any other suitable mechanism for transferring motion from the pulley 114 to the first plate 150 (or shaft 80) can be utilized.

Similar to the other systems 30 described herein, the lever arm 62 is linked for movement with the non-inertial or displacement load of the non-inertial or displacement resistance unit 50 (in at least some modes). In the illustrated arrangement, the lever arm 62 is linked to the non-inertial or displacement resistance unit 50 through a single cable (or other motion transfer element), which also engages the pulley 114. Thus, the single cable can have a portion 110 that extends from the pulley 114 to the lever arm 62 and another portion 118 that extends from the pulley 114 to the non-inertial or displacement resistance unit 50. As a result, displacement of the non-inertial or displacement resistance unit 50 is related to the motion of the pulley 114 and shaft 80, and is not influenced by any speed difference resulting from the transmission 200.

Figure 13:
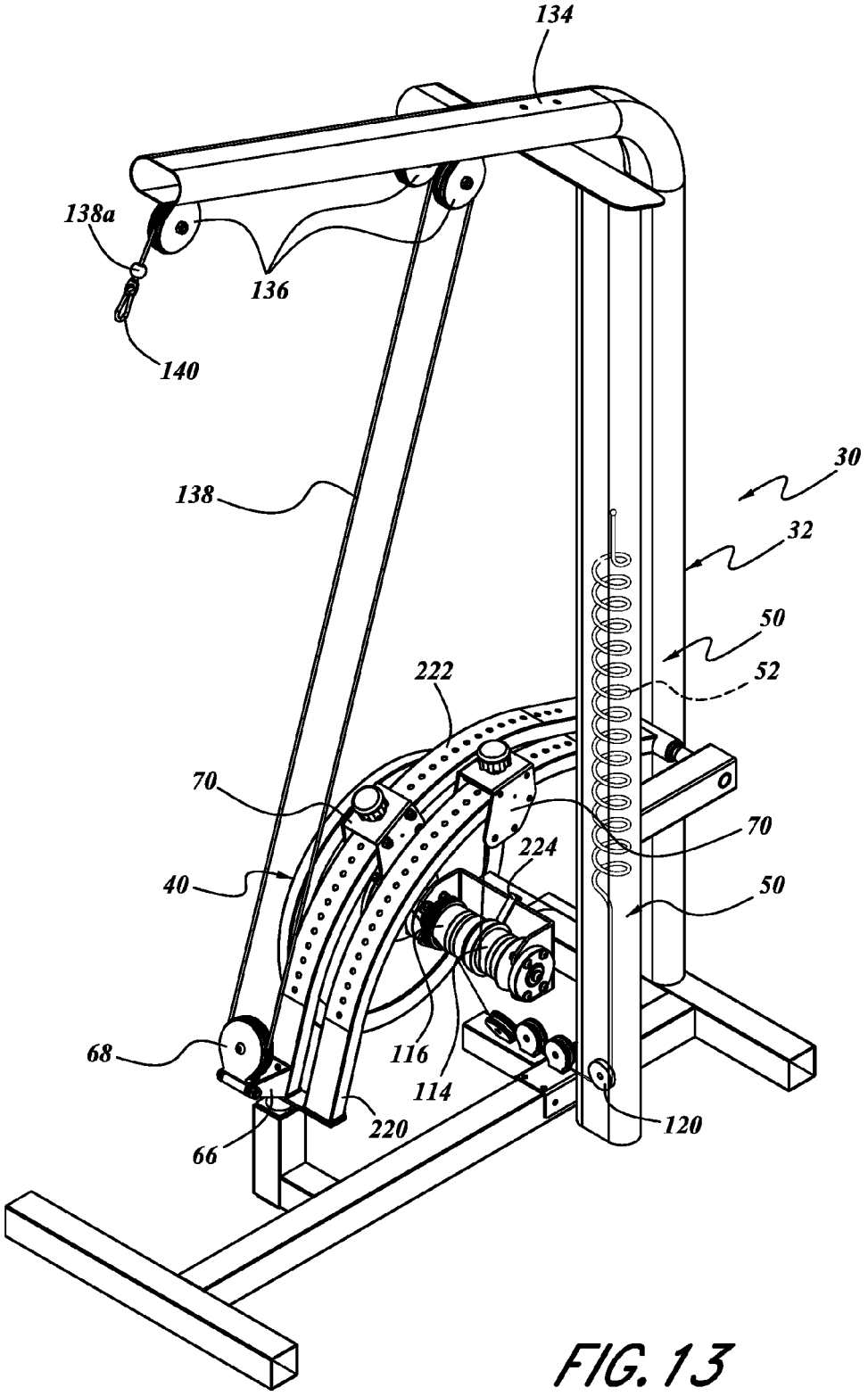
FIG. 13 is a perspective view of a front and side of another resistance system, which includes two lever arms.
Figure 14:
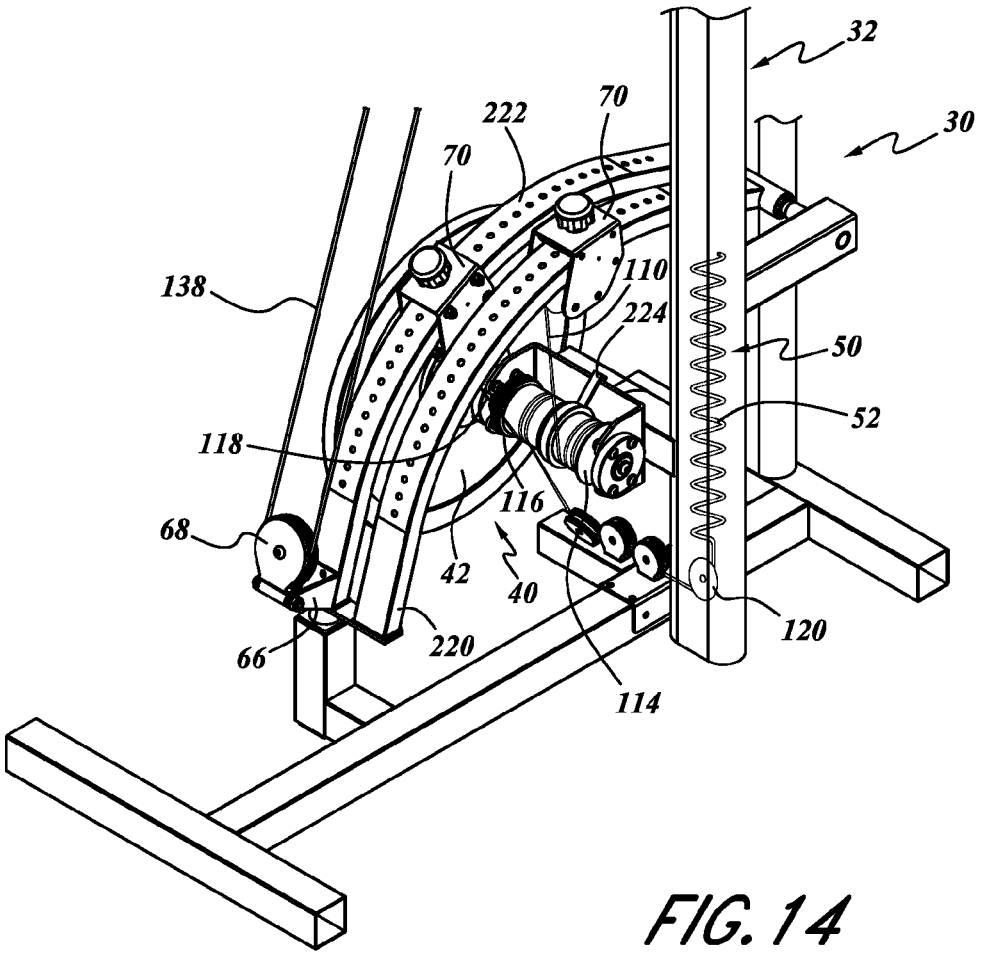
FIG. 14 is a perspective view of a portion of the front and side of the resistance system of FIG. 13.
Figure 15:
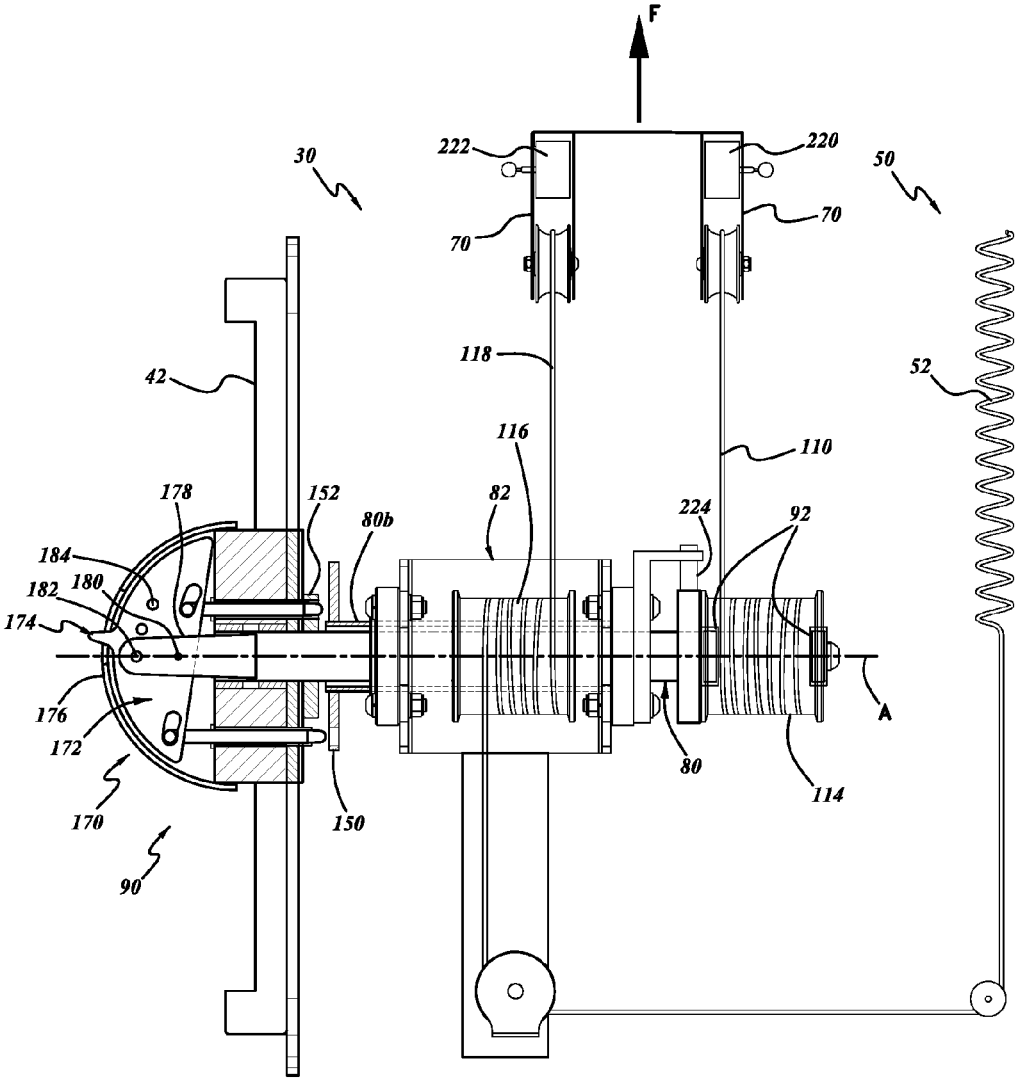
FIG. 15 is a schematic cross-sectional view of the resistance system of FIG. 13.

FIGS. 13-15 illustrate another version of the resistance system 30, which in many respects is similar to the systems 30 of FIGS. 1-6 and FIGS. 8-11 and FIG. 12. Accordingly, reference numbers are reused to indicate general correspondence between reference elements or features. In addition, the disclosure herein is primarily directed toward the differences in the system 30 of FIGS. 13-15 relative to the other systems 30 described herein. Therefore, any elements or features of the system 30 of FIGS. 13-15 not described in detail can be assumed to be the same as or similar to the corresponding elements or features of the other systems 30 described herein, or can be of any other suitable arrangement.

The system 30 of FIGS. 13-15 includes two lever arms in place of the single lever arm 62 of the prior systems 30. In particular, the system 30 of FIGS. 13-15 comprises a first lever arm 220 and a second lever arm 222. In the illustrated arrangement, the lever arms 220 and 222 are movable together, such as via the cable 138. However, in other arrangements, the lever arms 220 and 222 could be capable of actuation separately from one another. Each of the first lever arm 220 and the second lever arm 222 include an adjustment carriage 70, such that a position of the adjustment carriage 70 can be adjusted separately for each lever arm 220 and 222. Advantageously, with such an arrangement, in at least the cardio mode, the resistance offered by the inertial resistance unit 40 and the non-inertial or displacement resistance unit 50 can be set to different levels independently and can be combined into a concurrent hybrid resistance with more versatility. In some configurations, in at least the inertial mode and/or the non-inertial mode, the resistance is completely or primarily determined by the adjustment carriage 70 of the second lever arm 222.

The resistance system 30 of FIGS. 13-15 includes the first pulley 114 and the second pulley 116. The first pulley 114 is fixed for rotation with the shaft 80, which rotates inside and independently of an outer shaft 80*b*, via a one-way clutch arrangement 92. The second pulley 116 preferably is fixed for rotation with the outer shaft 80*b*. The first pulley 114 is coupled to the first lever arm 220 by a suitable motion transfer arrangement, such as a belt or the cable 110, for example, such that movement of the first lever arm 220 in at least one direction (e.g., in an upward direction in the illustrated arrangement) causes rotation of the first pulley 114. A biasing mechanism, such as a return spring (e.g., a torsion spring 224) can be provided to cause rotation of the pulley 114 and shaft 80 upon movement of the first lever arm 220 in a second direction (e.g., a downward direction in the illustrated arrangement) to rewrap the cable 110 onto the pulley 114. Unlike the prior systems 30, because the second pulley 116 is not fixed for rotation with the shaft 80, the non-inertial or displacement resistance unit 50 (e.g., the spring 52) does not provide a return force to the shaft 80. In an alternate configuration, where the lever arms 220 and 222 move independently of each other, the motion of lever arm 222 can be coupled to the motion of lever arm 220 allowing the non-inertial or displacement resistance unit 50 (e.g., the spring 52) to also provide a return force to the shaft 80.

The second pulley 116 is coupled to the second lever arm 222 by a suitable motion transfer arrangement, such as a belt or the cable 118. The second pulley 116 is also coupled to the non-inertial or displacement resistance unit 50 (e.g., spring 52) by a suitable motion transfer arrangement, which can be the cable 118 or a separate component. Accordingly, non-inertial or displacement resistance unit 50 is actuated by movement of the second lever arm 222 in at least one direction. In the illustrated arrangement, upward movement of the second lever arm 222 causes the spring 52 to extend, and the spring 52 produces a resistance force tending to move the second lever arm 222 in a downward direction.

The resistance system 30 can be adjusted to a desirable mode of operation by any suitable arrangement, such as any of the transmission arrangements 90 disclosed herein. For example, the available modes can include, but are not limited to, one or more of a cardio mode, an inertial mode and a non-inertial mode, as described herein. In an alternative arrangement, only the first pulley 114 is coupled to the shaft 80 and the second pulley 116 can be rotatable about the shaft 80. Accordingly, the first pulley 114 and lever arm 220 controls movement of the flywheel 42 or inertial resistance unit 40 and the second pulley 116 and lever arm 222 controls movement of the spring 52 or non-inertial resistance unit 50.

Figure 16:
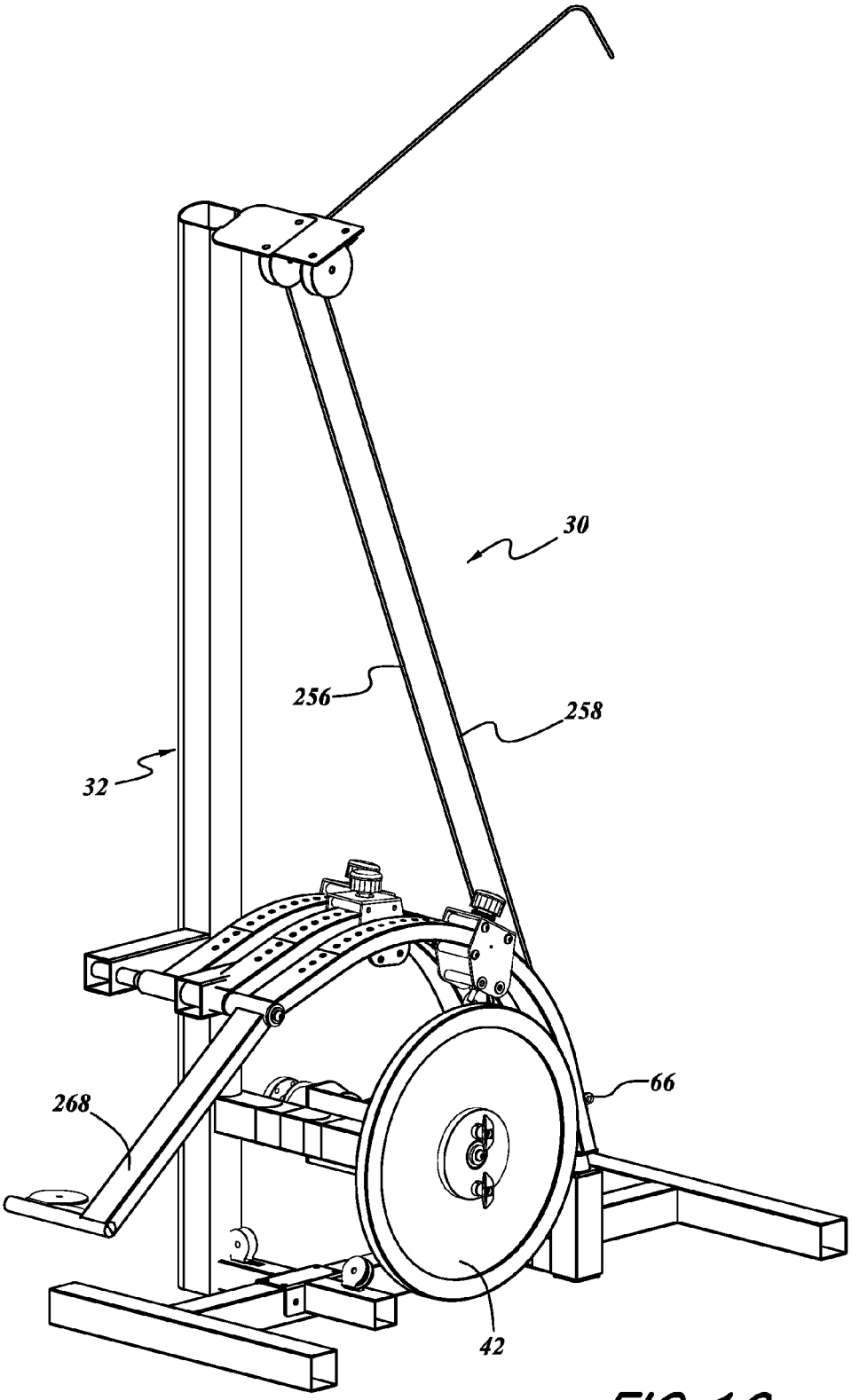
FIG. 16 is a perspective view of a side and rear of another resistance system, which includes three lever arms.
Figure 17:
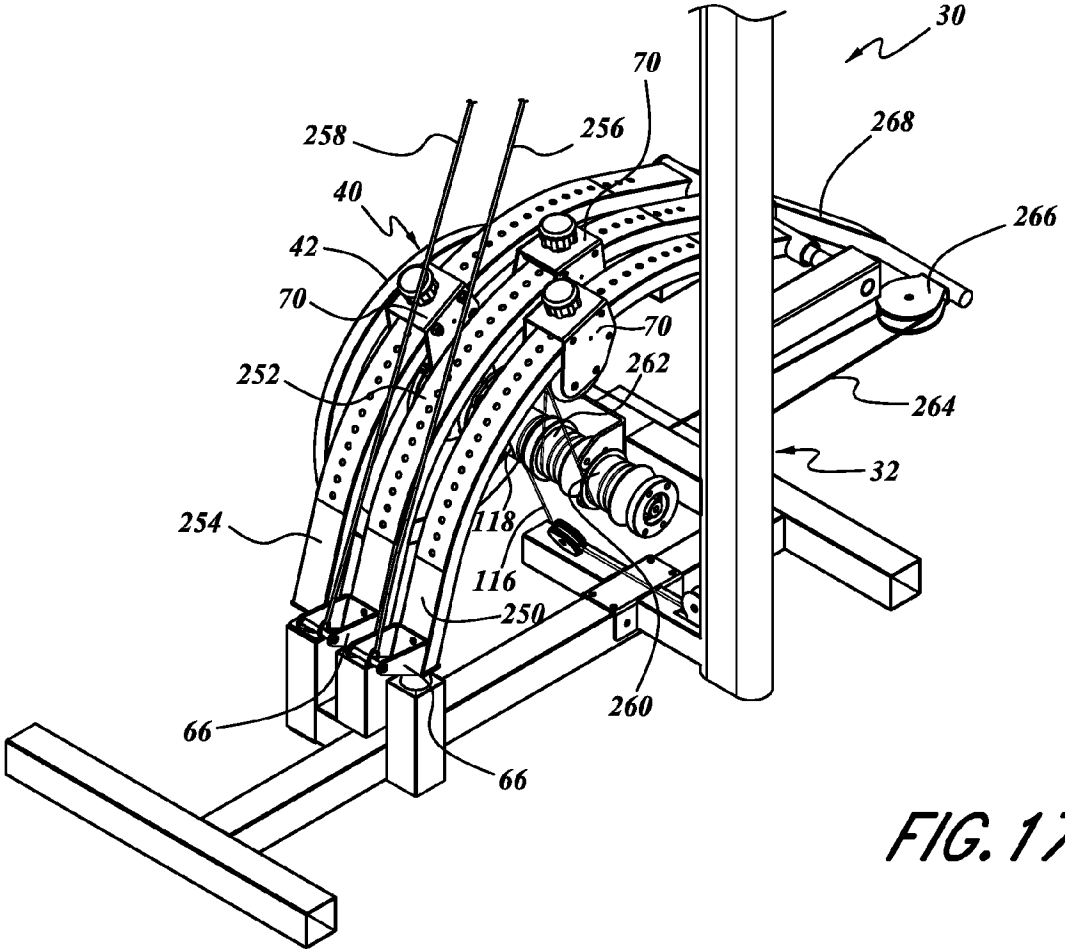
FIG. 17 is a perspective view of a portion of the other side and front of the resistance system of FIG. 16.
Figure 18:
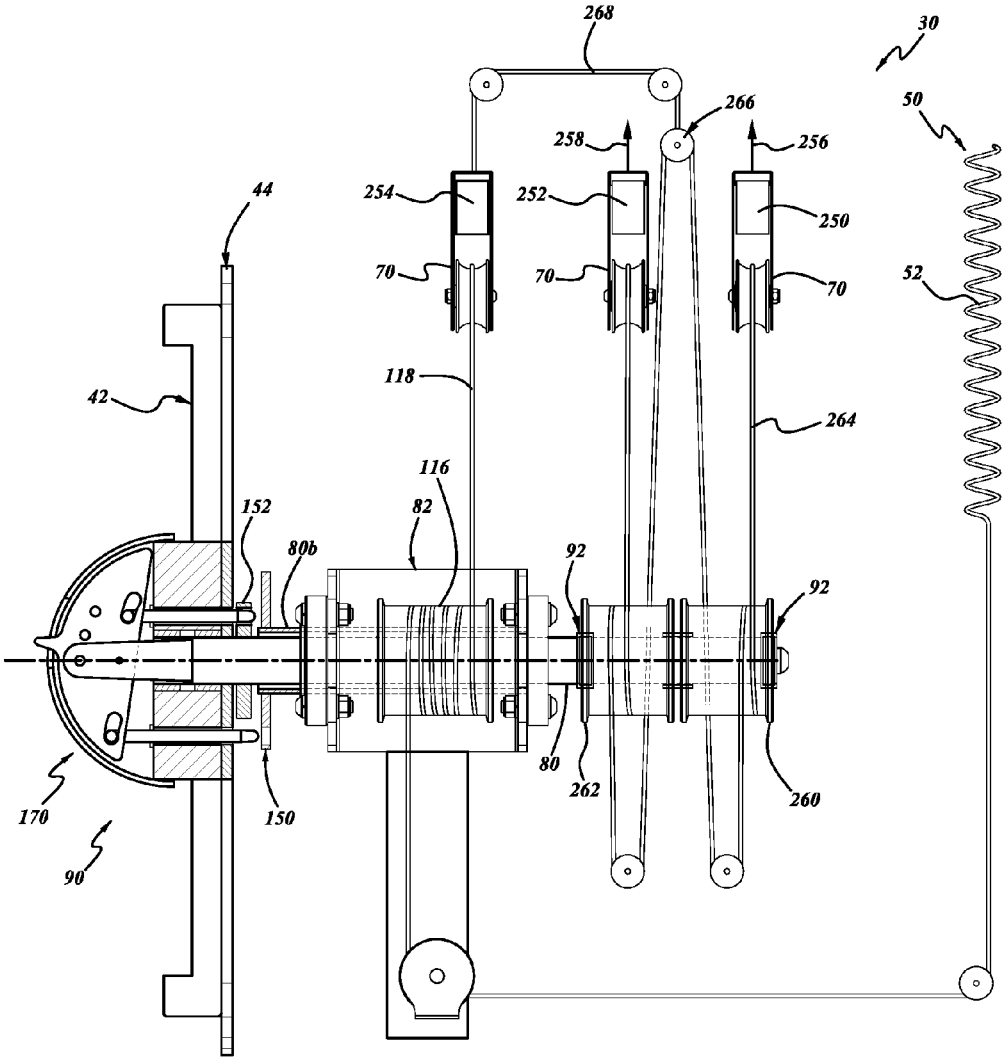
FIG. 18 is a schematic cross-section of the resistance system of FIG. 16.

FIGS. 16-18 illustrate another version of the resistance system 30, which in many respects is similar to the systems 30 of FIGS. 1-6 and FIGS. 8-11, FIG. 12 and FIGS. 13-15. Accordingly, reference numbers are reused to indicate general correspondence between reference elements or features. In addition, the disclosure herein is primarily directed toward the differences in the system 30 of FIGS. 16-18 relative to the other systems 30 described herein. Therefore, any elements or features of the system 30 of FIGS. 16-18 not described in detail can be assumed to be the same as or similar to the corresponding elements or features of the other systems 30 described herein, or can be of any other suitable arrangement.

The system 30 of FIGS. 16-18 includes three lever arms: a first lever arm 250, a second lever arm 252 and a third lever arm 254. The first lever arm 250 is coupled to a first motion transfer arrangement, such as a first cable or first input cable 256. The second lever arm 252 is coupled to a second motion transfer arrangement, such as a second cable or second input cable 258. The cables 256 and 258 can be utilized by a user of the system to actuate the lever arms 250 and 252 independently of one another, such as when used in an iso-lateral exercise, for example. The cables 256 and 258 can be coupled to a user interface, such as a handle, bar, grip, additional cable-and-pulley arrangement, or any other exercise device (e.g, an iso-lateral exercise device).

The system 30 of FIGS. 16-18 includes a first pulley 260 and a second pulley 262 in place of the first pulley 114 of the other systems 30 disclosed herein. The first lever arm 250 is coupled to the first pulley 260 and the second lever arm 252 is coupled to the second pulley 262. Preferably, a single cable 264 extends from the adjustment carriage 70 of the first lever arm 250, wraps around the first pulley 260 and loops around a transfer pulley 266, which is connected to a rearward extension 268 (illustrated schematically in FIG. 18) of the third lever arm 254. From the transfer pulley 266, the cable extends back to the second pulley 262, wraps around the second pulley 262 and extends to the adjustment carriage 70 of the second lever arm 252. With such an arrangement, pulling of either input cable 256 or 258 raises the corresponding lever arm 250 or 252 thereby rotating the corresponding pulley 260 or 262 and, in at least one direction, the shaft 80. In addition, raising of the lever arm 250 or 252 and rotation of the pulley 260 or 262 reduces the effective length of the portion of the cable 264 extending between the pulleys 260 and 262 and extending around the transfer pulley 266. As a result, the transfer pulley 266 is pulled toward the pulleys 260 and 262, thereby rotating and raising the forward portion of the third lever arm 254.

The third lever arm 254 also includes an adjustment carriage 70. A motion transfer arrangement, such as a cable 118, extends from the adjustment carriage 70 of the third lever arm 254, wraps around the pulley 116 and is then connected to the non-inertial or displacement resistance unit 50 (e.g., spring 52). Raising of the third lever arm 254 rotates the pulley 116 and, in the illustrated arrangement, extends the spring 52, which provides a source of resistance. The spring 52 also acts as a return spring for the third lever arm 254 and, because of the interconnection between the third lever arm 254 and the first and second lever arms 250, 252, the spring 52 also acts as a return force for the first and second lever arms 250, 252.

The position of any of the adjustment carriages 70 can be varied to adjust a resistance offered by the inertial resistance unit 40 and/or the non-inertial or displacement resistance unit 50. Similar to the system 30 of FIGS. 13-15, preferably, the pulleys 260 and 262 are coupled to the shaft 80 by a one-way clutch arrangement 92, such that the pulleys 260 and 262 rotate the shaft 80 in only one direction. In addition, the pulley 116 is coupled to an outer shaft 80*a* that surrounds and is rotatable relative to the shaft 80.

The resistance system 30 of FIGS. 16-18 can be adjusted to a desirable mode of operation by any suitable arrangement, such as any of the transmission arrangements 90 disclosed herein and, in particular, with the arrangement disclosed in connection with the system 30 of FIGS. 13-15. For example, the available modes can include, but are not limited to, one or more of a cardio mode, an inertial mode and a non-inertial mode, as described herein.

Figure 19:
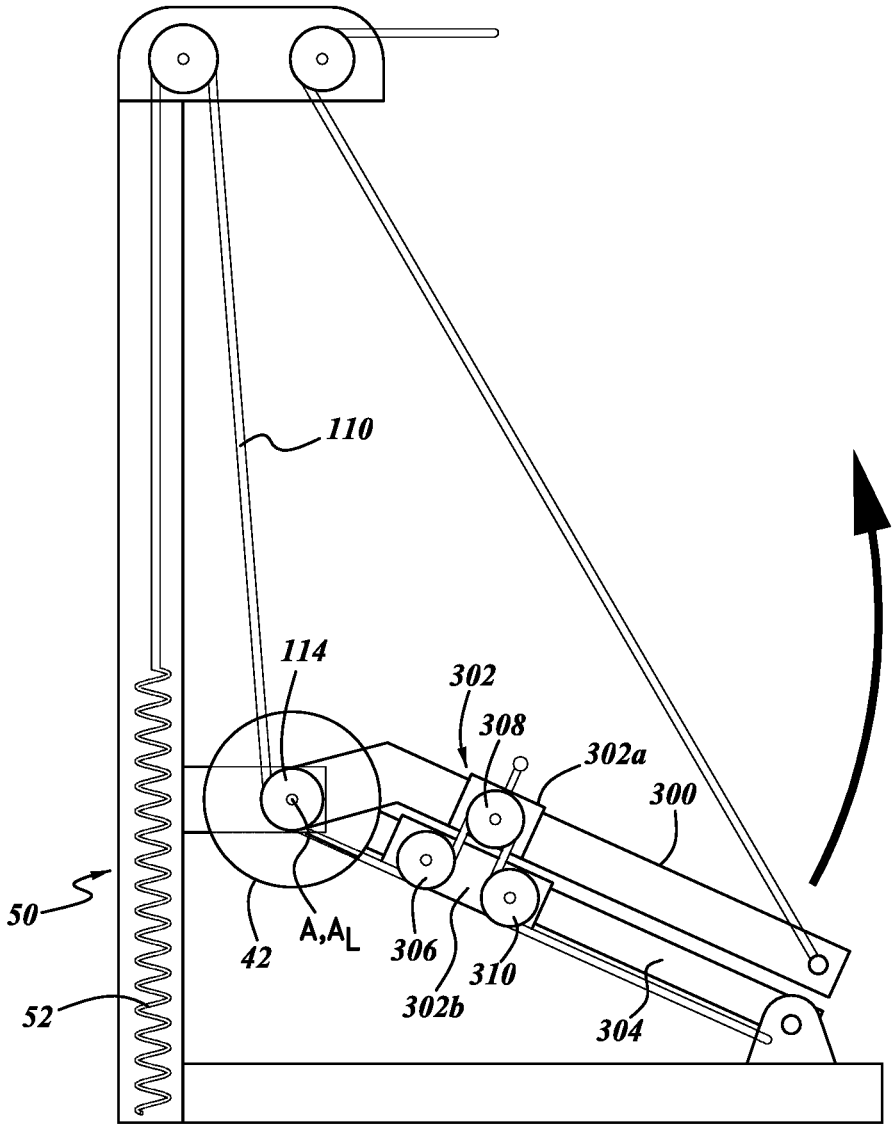
FIG. 19 is a side view of a resistance system having a straight lever arm assembly with a fixed lever arm and a movable lever arm.

In one configuration of the resistance system 30, as illustrated in FIG. 19, a straight lever arm 300 could incorporate dual adjustable carriages 302 where the dual adjustable carriages 302 preferably move together when adjusted along the straight lever arm 300 and parallel support structure (e.g., support or secondary arm) 304. In this case, the upper adjustable carriage 302*a* is held in place along the length of the straight lever arm 300 and moves with the straight lever arm 300, while the lower adjustable carriage 302*b* is held in place by the parallel support structure 304. The dual adjustable carriages 302 may be held in place along the straight lever arm 300 and the parallel support structure 304 with pop pins or any other suitable securement method. One end of a flexible, first elongate member 110 (e.g., a belt or cable) is secured to displacement resistance unit 50. The cable 110 is then wrapped around pulley 114 in the transmission 90. The axis A of the pulley 114 is coincident to or near the axis $A_L$ of the straight lever arm 300. The cable 110 then runs parallel to the straight lever arm 300, under a first pulley 306 on the lower adjustable carriage 302*b*, over pulley 308 on the upper adjustable carriage 302*a*, under a second pulley 310 on lower adjustable carriage 302*b*. The cable 110 then runs parallel to the straight lever arm 300 and is secured near the end of the parallel support structure 304 opposite the pivoting end of the straight lever arm 300. When the straight lever arm 300 is rotated in a first direction (e.g., upwardly), the dual adjustable carriages 302*a*, 302*b* separate from each other. This causes cable 110 to be drawn into the growing gap between the dual adjustable carriages 302*a*, 302*b*, which drives pulley 114 in a first direction. As the straight lever arm 300 moves in a second direction (e.g., downwardly), the dual adjustable carriages 302*a*, 302*b* move closer to each other. This causes cable 110 to be drawn out of the decreasing gap between the dual adjustable carriages 302*a*, 302*b*, which drives pulley 114 in the second direction. In alternate configurations, the transmission system 90 axis A does not have to be coincident or near the straight lever arm 300 axis $A_L$, and different pulley configurations can be used on the dual adjustable carriages 302*a*, 302*b*. In all embodiments, the components do not need to be on a single shaft, as illustrated, but can be provided on separate shafts that can be spaced from one another.

In one or more embodiments, the cable wrap pulleys (e.g., 114, 116, 260, 262) can be conical in nature to increase or decrease, during the rotation of the pulley, the effective radius of the cable from the transmission axis A, resulting in increasing or decreasing, during the rotation of the pulley, the effective leverage distance for the force the cable is carrying. The result is to increase or decrease the force needed at the end of the lever arm 42 to move lever arm 42. This can be used, along with other parameters within the design, to create the desired force curve felt by the user.

In one or more embodiments, the flexible, elongate member (e.g., 118), such as a belt or cable, that engages the spring 52 can be utilized to also engage another resistance source. In other words, instead of securing an end of the flexible, elongate member that is opposite the spring 52 to the associated pulley (e.g., 116) or a fixed structure, the end can be secured to another type of resistance source or to another exercise apparatus or device.

As discussed above, any of the resistance systems 30 can be used with a wide variety of user interfaces to facilitate a wide variety of exercises. For example, the systems 30 are well-suited for use in connection with traditional cardiovascular machines, such as: treadmills, elliptical machines, bicycles, steppers, stair climbers and rowers, for example and without limitation. In addition, the systems 30 are well-suited for use with traditional strength training machines, such as: multi gyms, cable crossovers, radial arm pull machines and other core exercise cable machines, abdominal and back machines, upper body press machines, row machines, lat pull machines, squat machines, leg press, extension, and curl machines, arm bicep and tricep machines, inner-outer thigh machines, glute machines, and calf machines, for example and without limitation. Among other uses, the systems 30 can also be useful in medical rehabilitation machines, including those that offload a patient's body weight. Furthermore, in the non-inertial mode, the first or inertial resistance unit (e.g., flywheel 42 and any associated friction, electromagnetic, etc. resistances) can be accessed by other apparatuses, cardio machines, etc. allowing dual concurrent, though not hybrid, uses of the resistance system 30.

The flywheels 42 disclosed herein can include a disc (e.g., a translucent disc) covering a portion of the flywheel 42, such as the openings between the spokes of the flywheel 42 as an added safety element to inhibit or prevent body parts or items from getting caught in the flywheel 42 while it is rotating. This will inhibit or prevent the need for a shroud covering the flywheel 42 and will result in the ability to add aesthetics to the flywheel 42 through both the aesthetics of the translucent disc and by having an LED light or other light source, which can optionally be powered by power obtained from the electronic, magnetic or electromagnetic resistance element (e.g., ring 44) of the flywheel 42. Such an arrangement can permit the light source to be viewable through the translucent disc. Having an electronic, magnetic, or electromagnetic resistance element (e.g., ring 44) as part of the resistance system 30 can provide power to the resistance system 30 for an optional computer to track workout data such as elapsed time or duration, calories burned, maximum and minimum efforts or forces, heart rate thru the use of a heart rate monitor, etc. for a complete workout which can now include cardiovascular, strength, and hybrid exercises combining the two all on one computer integrated into one hybrid resistance system 30.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present resistance system has been described in the context of particularly preferred embodiments, the skilled artisan will appreciate, in view of the present disclosure, that certain advantages, features and aspects of the system may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Moreover, not all of the features, aspects and advantages are necessarily required to practice the present invention. Thus, it is intended that the scope of the present invention herein disclosed should not be limited by the particular disclosed embodiments described above, but should be determined only by a fair reading of the claims.

What is claimed is:

1. A resistance system for incorporation in exercise equipment, comprising:

a first resistance unit having a first resistance property;

a second resistance unit having a second resistance property that is non-inertial and different than the first resistance property, said second resistance unit comprising a user selectable load adjuster;

a user interface that is movable by a user in a first direction and a second direction, wherein the resistance system comprises a uni-directional mode in which the user interface utilizes a load of the first resistance unit in only one of the first and second directions and utilizes a load of the second resistance unit in at least one of the first and second directions;

wherein the user selectable load adjuster is configured to permit adjustment of the load of the second resistance unit in each of the first and second directions.

2. The resistance system of claim 1, further comprising a mode selector that permits selection between at least a bi-directional mode and the uni-directional mode, wherein, in the bi-directional mode, the user interface utilizes the first resistance unit in both of the first and second directions and utilizes the second resistance unit in at least one of the first and second directions.

3. The resistance system of claim 2, wherein each of the loads of the first resistance unit and the second resistance unit is a non-active or a non-driving resistance load.

4. The resistance system of claim 2, wherein the mode selector permits selection of a neutral mode, and, in the neutral mode, the user interface does not utilize the first resistance unit in either of the first and second directions and utilizes the second resistance unit in at least one of the first and second directions.

5. The resistance system of claim 1, further comprising at least one connection between the user interface and the first and second resistance units.

6. The resistance system of claim 5, wherein the at least one connection comprises a first connection between the user interface and the first resistance unit and a second connection between the user interface and the second resistance unit.

7. The resistance system of claim 1, further comprising a first resistance unit adjuster that permits a user to adjust the load of the first resistance unit.

8. The resistance system of claim 7, wherein one or both of the user selectable load adjuster of the second resistance unit and the first resistance unit adjuster comprises a plurality of discrete adjustment positions.

9. The resistance system of claim 1, further comprising a third resistance unit having a load that is utilized in response to movement of the user interface in at least one of the first and second directions.

10. The resistance system of claim 1, wherein the user interface comprises a first user input and a second user input.

11. The resistance system of claim 10, wherein the first resistance unit and the second resistance unit are linked to the first input and the second input such that movement of either of the first input or the second input utilizes the loads of the first resistance unit and the second resistance unit.

12. The resistance system of claim 10, wherein the user interface also comprises a variable drive.

13. The resistance system of claim 1, wherein each of the loads of the first resistance unit and the second resistance unit is a non-active or a non-driving resistance load.

14. The resistance system of claim 1, wherein the first resistance unit or the second resistance unit comprises an active or a driving resistance load.

15. The resistance system of claim 1, wherein the first resistance unit comprises a rotational resistance load.

16. The resistance system of claim 1, wherein the first resistance unit provides a bidirectional resistance and the second resistance unit provides a unidirectional resistance.

17. A method of using an exercise resistance system, comprising:

selecting a level of resistance from a second resistance unit, wherein the second resistance unit is configured such that the selecting effects the magnitude in each of a first direction and a second direction of movement of a user interface;

moving or controlling movement of the user interface in the first direction in response to a force applied by the resistance system comprising a combination of a load of a first resistance unit and a load of the second resistance unit, wherein the load of the first resistance unit has a first resistance property and the load of the second resistance unit has a second property that is non-inertial and is different than the first resistance property;

moving or controlling movement of the user interface in the second direction in response to a force applied by the resistance system comprising a load of the second resistance unit and not a load of the first resistance unit.

18. The method of claim 17, wherein the moving or controlling movement of the user interface comprises moving or controlling movement of a variable drive.

19. The method of claim 17, further comprising selecting a different mode of resistance, wherein the moving or controlling movement of the user interface in the first direction includes the combination of the load of the first resistance unit and the load of the second resistance unit, and the moving or controlling movement of the user interface in the second direction includes the combination of the loads of the first resistance unit and the second resistance unit.

20. A resistance system for incorporation in exercise equipment, comprising:

a first resistance unit having a first resistance property;

a second resistance unit having a second resistance property that is non-inertial and different than the first resistance property, said second resistance unit comprising a user selectable load adjuster;

a user interface that is movable by a user in a first direction and a second direction, wherein the resistance system comprises a uni-directional mode in which the user interface utilizes a load of the first resistance unit in only one of the first and second directions and utilizes a load of the second resistance unit in at least one of the first and second directions;

wherein the user selectable load adjuster is configured to permit adjustment of the load of the second resistance unit in each of the first and second directions;

wherein the load of the second resistance unit is exerted in a single direction.

21. The resistance system of claim 20, further comprising a mode selector that permits selection between at least a bi-directional mode and the uni-directional mode, wherein, in the bi-directional mode, the user interface utilizes the first resistance unit in both of the first and second directions and utilizes the second resistance unit in at least one of the first and second directions.

22. The resistance system of claim 21, wherein each of the loads of the first resistance unit and the second resistance unit is a non-active or a non-driving resistance load.

23. The resistance system of claim 20, further comprising at least one connection between the user interface and the first and second resistance units.

24. The resistance system of claim 23, wherein the at least one connection comprises a first connection between the user interface and the first resistance unit and a second connection between the user interface and the second resistance unit.

25. The resistance system of claim 20, further comprising a first resistance unit adjuster that permits a user to adjust the load of the first resistance unit.

26. The resistance system of claim 20, further comprising a third resistance unit having a load that is utilized in response to movement of the user interface in at least one of the first and second directions.

27. The resistance system of claim 20, wherein the user interface comprises a first user input and a second user input.

28. The resistance system of claim 27, wherein the user interface also comprises a variable drive.

29. The resistance system of claim 27, wherein the first resistance unit and the second resistance unit are linked to the first input and the second input such that movement of either of the first input or the second input utilizes the loads of the first resistance unit and the second resistance unit.

30. The resistance system of claim 20, wherein each of the loads of the first resistance unit and the second resistance unit is a non-active or a non-driving resistance load.

31. The resistance system of claim 20, wherein the first resistance unit or the second resistance unit comprises an active or a driving resistance load.

32. The resistance system of claim 20, wherein the first resistance unit comprises a rotational resistance load.

33. The resistance system of claim 20, wherein the first resistance unit provides a bidirectional resistance and the second resistance unit provides a unidirectional resistance.

* * * * *